US010012938B2

(12) United States Patent
Miyajima

(10) Patent No.: US 10,012,938 B2
(45) Date of Patent: Jul. 3, 2018

(54) ILLUMINATION OPTICAL SYSTEM, AND SPECTROPHOTOMETRIC APPARATUS AND IMAGE FORMING APPARATUS INCLUDING THE SAME

(71) Applicant: CANON KABUSHIKI KAISHA, Tokyo (JP)

(72) Inventor: Yu Miyajima, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/347,263

(22) Filed: Nov. 9, 2016

(65) Prior Publication Data

US 2017/0131669 A1 May 11, 2017

(30) Foreign Application Priority Data

Nov. 11, 2015 (JP) ..... 2015-221260

(51) Int. Cl.

| | |
|---|---|
| ***G03G 15/04*** | (2006.01) |
| ***G03G 15/00*** | (2006.01) |
| ***F21V 7/08*** | (2006.01) |
| ***G03G 15/043*** | (2006.01) |

(Continued)

(52) U.S. Cl.

CPC ..... *G03G 15/50* (2013.01); *F21V 7/08* (2013.01); *G03G 15/043* (2013.01); *G03G 15/5062* (2013.01); *F21Y 2115/10* (2016.08); *F21Y 2115/15* (2016.08); *G03G 2215/0145* (2013.01)

(58) Field of Classification Search

CPC .. G03G 15/043; G03G 15/50; G03G 15/5062; G03G 2215/0145; G03G 2215/00611; G03G 2215/00616; F21Y 2215/10; F21Y 2215/15; F21Y 2115/10; F21Y 2115/15; F21V 7/08

See application file for complete search history.

(56) References Cited

U.S. PATENT DOCUMENTS 6,612,730 B1 9/2003 Ikeda
2009/0296418 A1* 12/2009 Luo ..... F21K 9/00 362/516

(Continued)

FOREIGN PATENT DOCUMENTS

JP 2001-110217 A 4/2001
JP 2001-147328 A 5/2001

(Continued)

*Primary Examiner* — Sophia S Chen
(74) *Attorney, Agent, or Firm* — Carter, Deluca, Farrell & Schmidt, LLP

(57) ABSTRACT

Provided is an illumination optical system includes: a light source; and a light guiding member configured to guide a light flux emitted from the light source to an illuminated surface, the light guiding member having: an incident surface into which the light flux from the light source enters; an ellipsoidal reflection surface configured to reflect the light flux from the incident surface; and an exit surface from which the light flux reflected by the ellipsoidal reflection surface exits, in which the light source is arranged so as to be separated from a first focal point of the ellipsoidal reflection surface at a position farther from the illuminated surface, in a direction perpendicular to a light emitting surface of the light source.

19 Claims, 19 Drawing Sheets

(51) Int. Cl.
*F21Y 115/10* (2016.01)
*F21Y 115/15* (2016.01)

(56) References Cited

U.S. PATENT DOCUMENTS

| | | | | |
|---|---|---|---|---|
| 2011/0044025 | A1* | 2/2011 | Ikeda | F21V 7/0091 362/84 |
| 2015/0078027 | A1* | 3/2015 | Ohno | F21S 48/1329 362/511 |
| 2016/0202393 | A1 | 7/2016 | Saiga et al. | |

FOREIGN PATENT DOCUMENTS

| | | | |
|---|---|---|---|
| JP | 2005-347224 | A | 12/2005 |
| JP | 2009-259564 | A | 11/2009 |
| JP | 2014-017052 | A | 1/2014 |
| JP | 2014-094122 | A | 5/2014 |

* cited by examiner

PRIOR ART

PRIOR ART

PRIOR ART

PRIOR ART

ILLUMINATION OPTICAL SYSTEM, AND SPECTROPHOTOMETRIC APPARATUS AND IMAGE FORMING APPARATUS INCLUDING THE SAME

BACKGROUND OF THE INVENTION

Field of the Invention

The present invention relates to an illumination optical system, and to a spectrophotometric apparatus and an image forming apparatus including the same.

Description of the Related Art

In recent years, there has been developed an illumination optical system utilizing an ellipsoidal reflection surface that is effective for development of illumination efficiency.

In Japanese Patent Application Laid-Open No. 2014-94122, there is disclosed an apparatus configured to collect illumination light emitted from an optical fiber onto a sample with use of an ellipsoidal reflection surface.

In Japanese Patent Application Laid-Open No. 2014-17052, there is disclosed an apparatus configured to collect illumination light emitted from an LED with use of a hollow ellipsoidal reflection surface.

However, in the apparatus disclosed in Japanese Patent Application Laid-Open Nos. 2014-94122 and 2014-17052, the light source is arranged on a focal point of the ellipsoidal reflection surface. Therefore, when the light source is not arranged at a nominal dimension due to an arrangement error, the amount of light collected to an object is sharply decreased. That is, there is a problem in that the illumination efficiency is sensitive to the arrangement error of the light source. In the following, for the sake of easy description, arrangement at the nominal dimension is referred to as "nominal arrangement", and arrangement not at the nominal dimension is referred to as "non-nominal arrangement".

In particular, when the LED is used as the light source as in Japanese Patent Application Laid-Open No. 2014-17052, it is difficult to control the tolerance in positional variation of a light emitting portion inside the LED light source. Therefore, the variation in illumination efficiency due to the tolerance tends to be a problem.

SUMMARY OF THE INVENTION

The present invention has an object to provide an illumination optical system capable of preventing an amount of light detected on an illuminated surface from being sharply decreased even when a light source is arranged at a non-nominal arrangement due to an arrangement error.

According to one embodiment of the present invention, there is provided an illumination optical system, including: a light source; and a light guiding member configured to guide a light flux emitted from the light source to an illuminated surface, the light guiding member having: an incident surface into which the light flux from the light source enters; an ellipsoidal reflection surface configured to reflect the light flux from the incident surface; and an exit surface from which the light flux reflected by the ellipsoidal reflection surface exits, in which the light source is arranged so as to be separated from a first focal point of the ellipsoidal reflection surface at a position farther from the illuminated surface, in a direction perpendicular to a light emitting surface of the light source.

Further features of the present invention will become apparent from the following description of exemplary embodiments with reference to the attached drawings.

DESCRIPTION OF THE EMBODIMENTS

First Embodiment

Now, an illumination optical systems according to various embodiments of the present invention are described with reference to the drawings. In order to facilitate the understanding of the present invention, figures referred to below may be illustrated in scales different from actual ones.

Figure 1A:
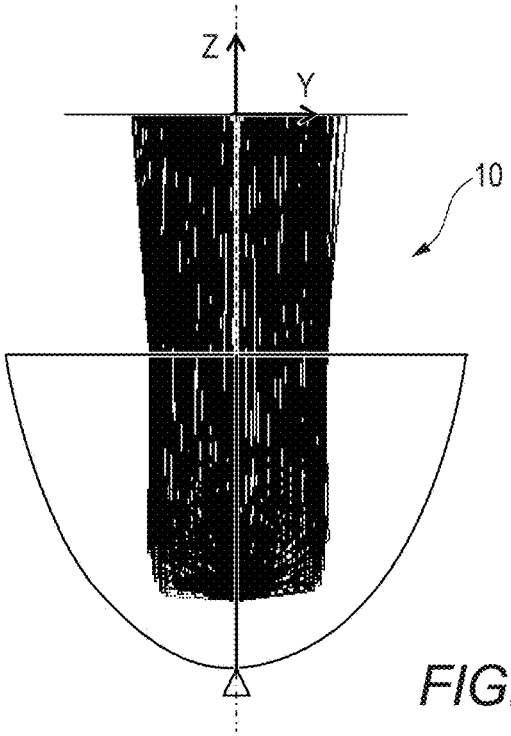
FIG. 1A is a YZ sectional view of an illumination optical system according to a first embodiment of the present invention.
Figure 1B:
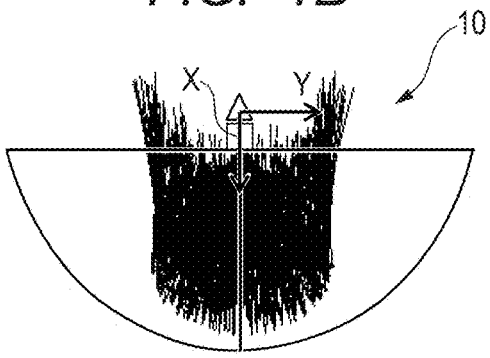
FIG. 1B is an XY sectional view of the illumination optical system according to the first embodiment.
Figure 1C:
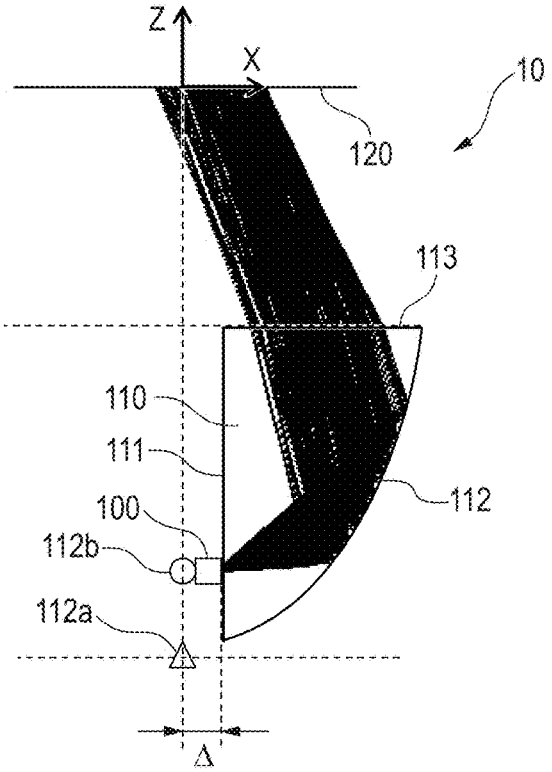
FIG. 1C is an XZ sectional view of the illumination optical system according to the first embodiment.

FIG. 1A, FIG. 1B, and FIG. 1C are a YZ sectional view, an XY sectional view, and an XZ sectional view, respectively, of an illumination optical system 10 according to the first embodiment.

The illumination optical system 10 includes an LED 100 and a light guiding member 110.

The LED 100 is a light source including a light emitting portion of 0.2 mm×0.2 mm.

The light guiding member 110 is made of ACRYPET (trademark), and has an incident surface 111, an ellipsoidal reflection surface 112, and an exit surface 113. That is, the light guiding member 110 is a solid light guiding member made of ACRYPET (resin). In this case, the solid light guiding member made of resin means that the inside of the light guiding member is filled with resin. Further, regarding the shape of the ellipsoidal reflection surface 112 in this embodiment, an ellipse is not limited to an ellipse in a strict sense, and includes a shape that is approximately regarded as an ellipse (substantial ellipse).

Both of the incident surface 111 and the exit surface 113 are planes. Therefore, the light guiding member 110 has a shape obtained by cutting a spheroid with planes.

As illustrated in FIG. 1A to FIG. 1C, the LED 100 is arranged such that an exit surface of the LED 100 is in contact with the incident surface 111 of the light guiding member 110. In this embodiment, the LED 100 is arranged such that the exit surface of the LED 100 is in contact with the incident surface 111 of the light guiding member 110, but the exit surface of the LED 100 may be arranged close to the incident surface 111 of the light guiding member 110 such that a distance from the incident surface 111 of the light guiding member 110 to the exit surface of the LED 100 is 0.1 mm as an upper limit. The light beam emitted from the LED 100 enters the light guiding member 110 through the incident surface 111, and is then reflected by the ellipsoidal reflection surface 112. The reflected light beam is refracted at the exit surface 113 to be illuminated onto an illuminated surface 120.

Of the light fluxes emitted from the LED 100, almost all of the light fluxes not satisfying a total reflection condition of the ellipsoidal reflection surface 112 pass through the ellipsoidal reflection surface 112, and are not illuminated onto the illuminated surface 120. Such light fluxes are ignored in the following discussion, and illustration thereof is omitted in the drawings for the sake of clear description.

In this embodiment, the light guiding member is arranged such that one focal point of the spheroid defining the shape of the light guiding member is positioned on the illuminated surface 120. A line perpendicular to the illuminated surface 120, which passes through another focal point of the spheroid, is defined as a Z-axis. A direction obtained by projecting the normal direction to a light emitting surface of the LED 100 (hereinafter referred to as "emission direction") onto the illuminated surface 120 is defined as an X-axis, and a direction perpendicular to the X-axis and the Z-axis is defined as a Y-axis. Further, the intersection between the Z-axis and the illuminated surface 120 is set as an origin of a coordinate system according to this embodiment. The X-axis, the Y-axis, and the Z-axis defined in this embodiment and the origin of the illumination optical system are directly used in other embodiments described below as well.

Further, there is illustrated a surface vertex 112*a* on the focal point side not on the illuminated surface of the ellipsoidal reflection surface 112.

The ellipsoidal reflection surface 112 of the light guiding member 110 in the illumination optical system according to this embodiment is formed of a conic aspheric surface, and an aspheric surface shape thereof is represented by Expression (1).

$$z = \frac{\frac{(x^2 + y^2)}{R}}{1 + \sqrt{1 - (1 + k)\frac{x^2 + y^2}{R^2}}} \quad (1)$$

In Expression (1), R and k are a paraxial curvature radius and a conic constant of the ellipsoidal reflection surface 112, respectively. Further, x, y, and z (x-axis, y-axis, and z-axis) are local coordinates (axes) defined for the ellipsoidal reflection surface 112, respectively. That is, there is provided a local coordinate system in which a direction including two focal points of the spheroid defining the ellipsoidal reflection surface is the z-axis, an intersection of the spheroid with the z-axis is an origin, and two directions that are orthogonal to the z-axis and are perpendicular to each other are the x-axis and the y-axis.

It should be noted that, in the illumination optical system 10 according to the first embodiment, the light emitting surface of the LED 100 is arranged at a position shifted from a light-source-side focal point 112*b* of the ellipsoidal reflection surface 112 in the X direction (normal direction to the light emitting surface).

Next, the effects of the present invention are described by comparing the related-art illumination optical system with the illumination optical system according to this embodiment.

Figure 2A:
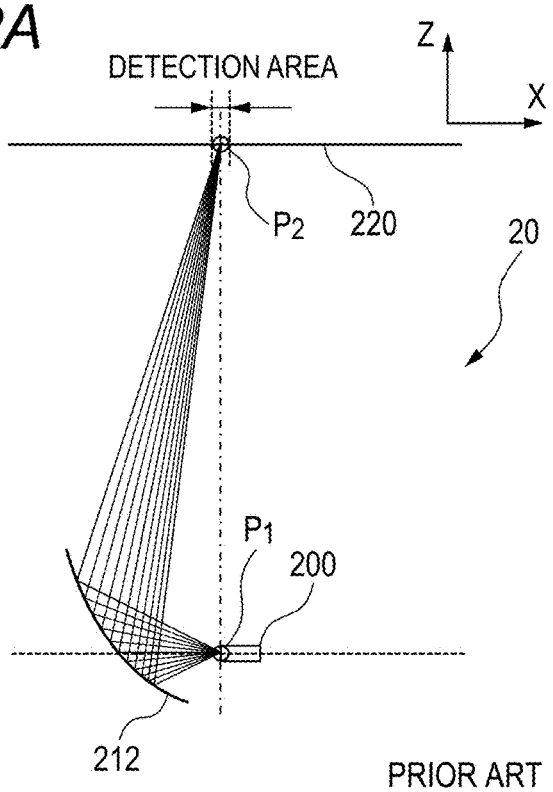
FIG. 2A is an XZ sectional view of a related-art illumination optical system at the time of a nominal arrangement.
Figure 2B:
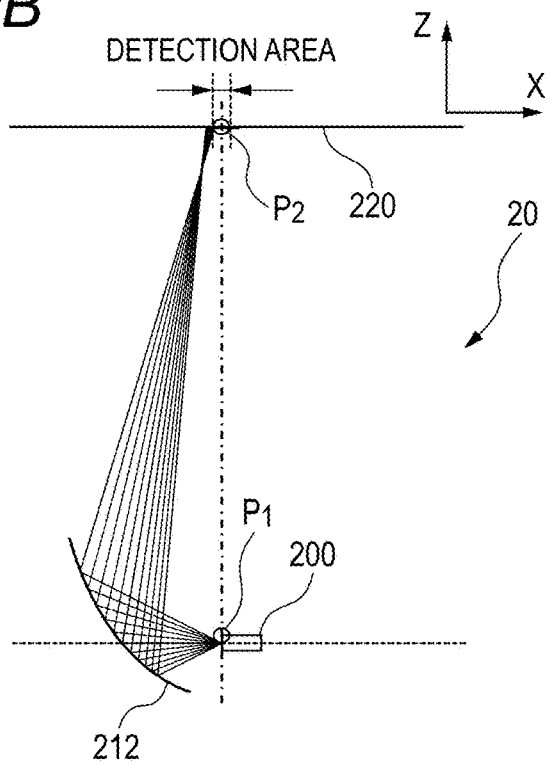
PRIOR ART FIG. 2B
FIG. 2B is an XZ sectional view of the related-art illumination optical system at the time of a non-nominal arrangement.

FIG. 2A is an XZ sectional view of a related-art illumination optical system 20 in a case where the light source is arranged at a nominal dimension (hereinafter also referred to as "at the time of a light source nominal arrangement"). In FIG. 2A and FIG. 2B, in order to clearly describe the effects of the invention with simple figures, only the reflection surface of the light guiding member is illustrated, and the illustration of the incident surface and the exit surface is omitted. The same holds true also in FIG. 3A, FIG. 3B, FIG. 4A, FIG. 4B, FIG. 10A, FIG. 10B and FIG. 10C.

In the illumination optical system 20, a light source 200 is arranged on one focal point $P_1$ of an ellipsoidal reflection surface 212 (focal point at a position farther from an illuminated surface 220).

The illuminated surface 220 is arranged so as to be parallel to an XY plane and to include another focal point $P_2$ of the ellipsoidal reflection surface 212 (focal point at a position closer to the illuminated surface 220).

As illustrated in FIG. 2A, the normal direction to the exit surface of the light source 200 is parallel to the X direction. The light flux emitted from the light source 200, which has a predetermined divergence angle, is reflected by the ellipsoidal reflection surface 212 to illuminate the position of the focal point $P_2$ on the illuminated surface 220.

FIG. 2B is an XZ sectional view of the related-art illumination optical system 20 in a case where the light source is arranged so as to be shifted from the nominal dimension (within the incident surface) (hereinafter also referred to as "at the time of a light source non-nominal arrangement"). In this case, the light source 200 is shifted in a direction of separating from the illuminated surface with respect to the focal point $P_1$ along the Z direction, that is, has an arrangement error of approaching the ellipsoidal reflection surface 212.

In this case, the light flux emitted from the light source 200, which has a predetermined divergence angle, is reflected by the ellipsoidal reflection surface 212, and illuminates the illuminated surface 220 about a position shifted from the focal point $P_2$ on the illuminated surface 220 while the light collecting degree is degraded.

In this case, considering a case where a detection unit (not shown) detects a predetermined area on the illuminated surface 220 (hereinafter referred to as "detection area"), when the light source 200 has an arrangement error as illustrated in FIG. 2B, the light amount of the light flux illuminating the detection area is decreased, and the detection performance of the detection unit is degraded.

When such an illumination optical system is applied to a sensor, a production yield may be decreased due to detection performance failure and the performance variation in each product may be increased even when a satisfactory detection performance is obtained.

Figure 3A:
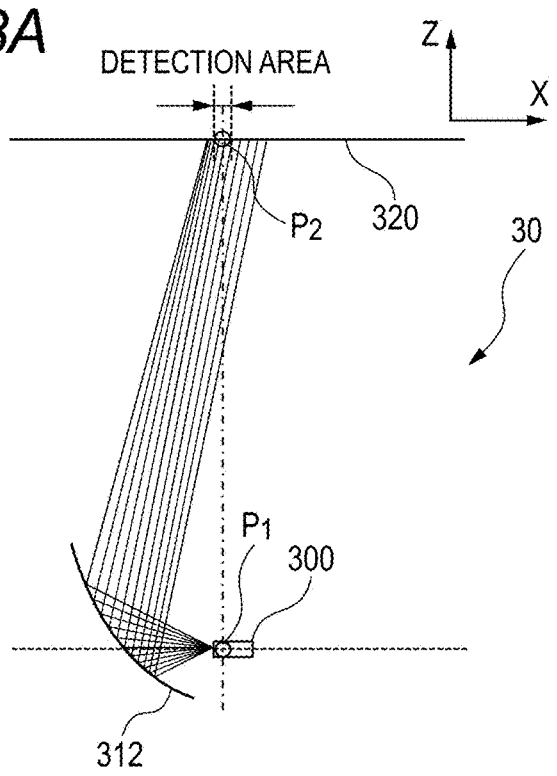
FIG. 3A is an XZ sectional view of an illumination optical system according to the first embodiment at the time of the nominal arrangement.

FIG. 3A is an XZ sectional view of an illumination optical system 30 according to the first embodiment of the present invention at the time of the light source nominal arrangement.

In the illumination optical system 30 of this embodiment, a light source 300 is arranged at a position shifted in the X direction from one focal point $P_1$ of an ellipsoidal reflection surface 312.

An illuminated surface 320 is arranged so as to be parallel to the XY plane and to include another focal point $P_2$ of the ellipsoidal reflection surface 312.

As illustrated in FIG. 3A, the normal direction to the light emitting surface of the light source 300 is parallel to the X direction. The light flux emitted from the light source 300, which has a predetermined divergence angle, is reflected by the ellipsoidal reflection surface 312, and illuminates the vicinity of the focal point $P_2$ on the illuminated surface 320.

That is, the light source 300 is arranged at a position shifted in the X direction from the focal point $P_1$ of the ellipsoidal reflection surface 312, and hence light is not collected at the position of the focal point $P_2$ on the illuminated surface 320. Therefore, as compared to a case where the light source 300 is arranged on the focal point $P_1$, the vicinity of the focal point $P_2$ on the illuminated surface 320 is illuminated in a wide area while the light collecting degree is degraded.

Figure 3B:
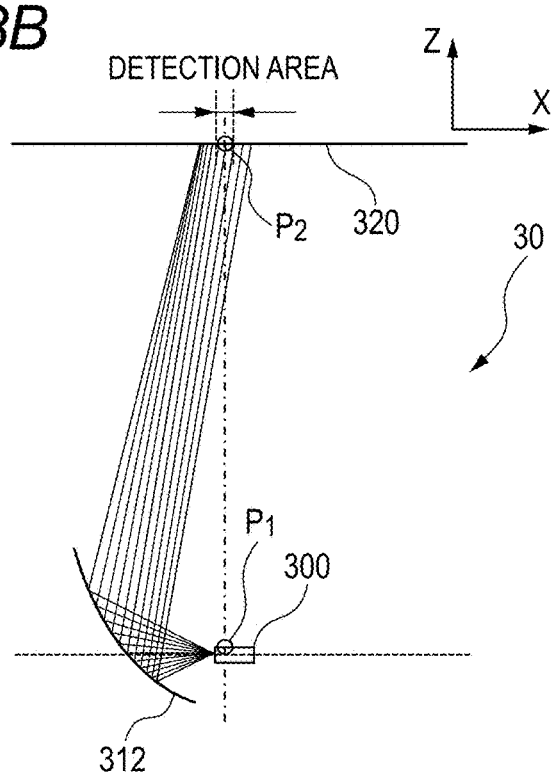
FIG. 3B is an XZ sectional view of the illumination optical system according to the first embodiment at the time of the non-nominal arrangement.

FIG. 3B is an XZ sectional view of the illumination optical system 30 according to the present invention at the time of the light source non-nominal arrangement. In this case, the light source 300 is shifted in a direction of separating from the illuminated surface 320 along the Z direction with respect to the position of the light source 300 at the time of the nominal arrangement illustrated in FIG. 3A, and has an arrangement error of approaching the ellipsoidal reflection surface 312.

In this case, the light flux emitted from the light source 300, which has a predetermined divergence angle, is reflected by the ellipsoidal reflection surface 312, and illuminates the illuminated surface 320 in a large area with a distribution different from that at the time of the light source nominal arrangement.

As described above, in the related-art illumination optical system 20, when the light source nominal arrangement is changed to the light source non-nominal arrangement, the light amount of the light flux illuminating the detection area on the illuminated surface 220 is sharply decreased.

Meanwhile, in the illumination optical system 30 according to this embodiment, even when the light source nominal arrangement is changed to the light source non-nominal arrangement, as illustrated in FIG. 3A and FIG. 3B, the light amount of the light flux illuminating the detection area on the illuminated surface 320 is not sharply decreased.

Therefore, in the illumination optical system according to this embodiment, the detection performance of the detection unit is less liable to degrade even when the light source has an arrangement error. When such an illumination optical system is applied to a sensor, the decrease in the production yield due to the detection performance failure is eliminated, and the increase in performance variation in each product is prevented.

Next, the divergence angle of the light flux emitted from the light source is considered.

Figure 4A:
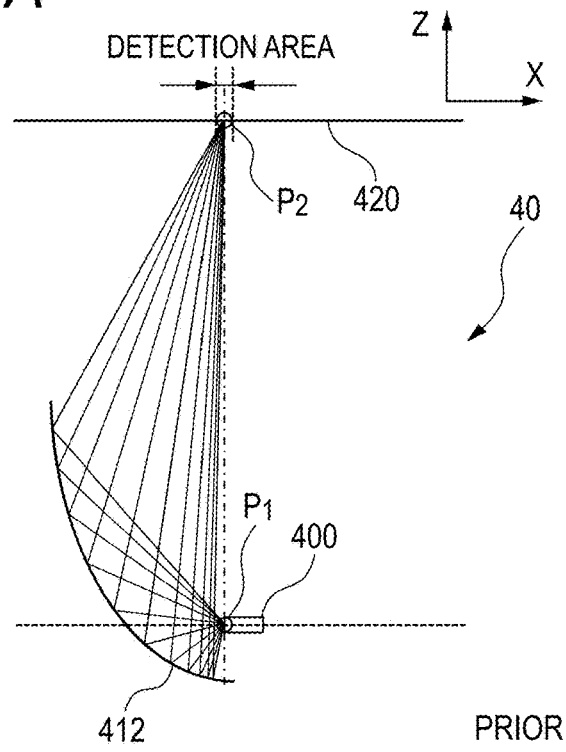
FIG. 4A is an XZ sectional view of a related-art illumination optical system at the time of the nominal arrangement.

FIG. 4A is an XZ sectional view of a related-art illumination optical system 40 at the time of the light source nominal arrangement.

In the illumination optical system 40, an LED light source 400 is arranged on one focal point $P_1$ of an ellipsoidal reflection surface 412.

An illuminated surface 420 is arranged so as to be parallel to the XY plane and to include another focal point $P_2$ of the ellipsoidal reflection surface 412.

In this case, the divergence angle of the light flux emitted from the LED light source 400 is substantially from −90° to 90° with respect to the X-axis.

As illustrated in FIG. 4A, the normal direction to the light emitting surface of the LED light source 400 is parallel to the X direction. The light flux emitted from the LED light source 400 is reflected by the ellipsoidal reflection surface 412, and illuminates the position of the focal point $P_2$ on the illuminated surface 420.

Figure 4B:
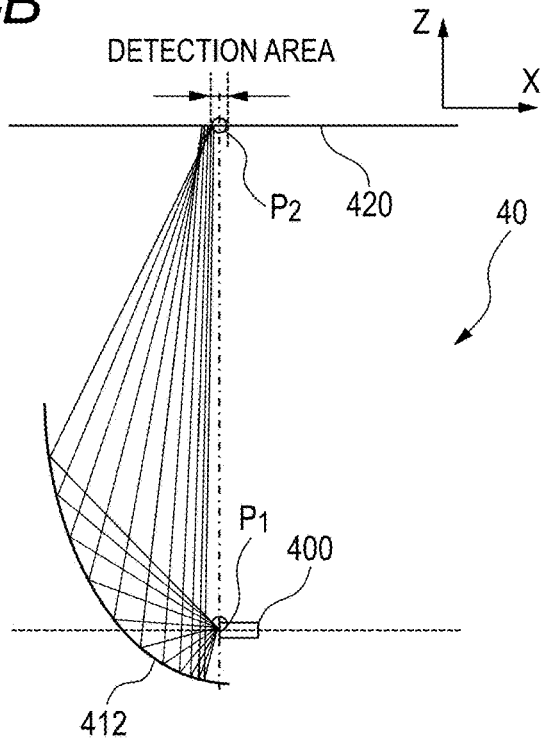
PRIOR ART FIG. 4B
FIG. 4B is an XZ sectional view of the related-art illumination optical system at the time of the non-nominal arrangement.

FIG. 4B is an XZ sectional view of the related-art illumination optical system 40 at the time of the light source non-nominal arrangement. In this case, the LED light source 400 is shifted in a direction of separating from the illuminated surface 420 along the Z direction with respect to the focal point $P_1$, and has an arrangement error of approaching the ellipsoidal reflection surface 412.

In this case, the light flux emitted from the LED light source 400 is reflected by the ellipsoidal reflection surface 412, and illuminates the illuminated surface 420 about a position shifted from the focal point $P_2$ on the illuminated surface 420 while the light collecting degree is degraded. In this case, it should be noted that, as compared to a case in FIG. 2B where the divergence angle is small, the illuminated area on the illuminated surface is increased.

However, in the illumination optical system 40, even when the light source nominal arrangement is changed to the light source non-nominal arrangement, the divergence angle of the light flux is large, and hence the light amount of the light flux illuminating the detection area on the illuminated surface 420 is not sharply decreased.

Therefore, the effects of the present invention become more remarkable when the divergence angle of the light flux emitted from the light source is small.

Specifically, a case where the light source is arranged close to the solid light guiding member corresponds to this case.

Also in the first embodiment, as illustrated in FIG. 1A, FIG. 1B, and FIG. 1C, in the illumination optical system 10, the LED 100 is arranged in contact with (close to) the incident surface 111 of the light guiding member 110. In this case, when the refractive index of the light guiding member 110 is represented by n, the divergence angle of the light flux emitted from the LED 100 is from −Arcsin(1/n) to Arcsin(1/n) based on the Snell's law.

When the light guiding member 110 is made of plastic or glass, and n is 1.5, the divergence angle of the light flux emitted from the LED 100 is from −41.8° to 41.8°, and a configuration with a small divergence angle is obtained.

Next, the effects obtained in the illumination optical system according to this embodiment are described with use of specific numerical values.

In Table 1 below, optical design values of the illumination optical system 10 according to the first embodiment are shown.

TABLE 1

Optical design values of illumination optical system 10 according to first embodiment

| | Symbol | Value |
|---|---|---|
| LED dominant wavelength | λ | 780 nm |
| Refractive index | n(λ) | 1.49361 |
| Ellipsoidal aspheric surface coefficient | R | 4.00328 |
| | K | −0.67186 |
| Light source main exit angle | θ | 90 |
| Separation amount between focal point and light source (mm) | Δ | 1 |
| Maximum value of separation amount between focal point and light source (mm) | Δmax | 4.003 |
| Ellipsoidal reflection surface magnification | β | 5.1 |
| Light source main incident angle | φ | 39.3 |
| Critical angle | φm | 42.0 |

| | Coordinate | | | Tilt (surface normal direction) | | |
|---|---|---|---|---|---|---|
| | X | Y | Z | TiltX | TiltY | TiltZ |
| LED light emitting surface center position | 1 | 0 | −14 | — | — | — |
| Incident surface | 1 | 0 | −14 | — | 90 | 0 |
| Ellipsoidal reflection surface vertex | 0 | 0 | −16.2 | 90 | 0 | — |
| Ellipsoidal reflection surface light-source-side focal point | 0 | 0 | −14 | — | — | — |
| Exit surface | 0 | 0 | −7 | 90 | 0 | — |
| Illuminated surface | 0 | 0 | 0 | 0 | 0 | — |
| Detection center position | 2 | 0 | 0 | — | — | — |

In Table 1, TiltX, TiltY, and TiltZ mean angles about the X-axis, the Y-axis, and the Z-axis of the normal to a target surface, respectively. This definition holds true also in tables below.

As shown in Table 1, the center position of the light emitting surface of the LED 100 is separated by Δ=1 mm from the light-source-side focal point 112*b* of the ellipsoidal reflection surface 112 in the X direction (emission direction). In other words, the LED 100 is arranged so as to be separated by Δ=1 mm from the light-source-side focal point 112*b* in the normal direction to the light emitting surface of the LED 100.

Figure 5A:
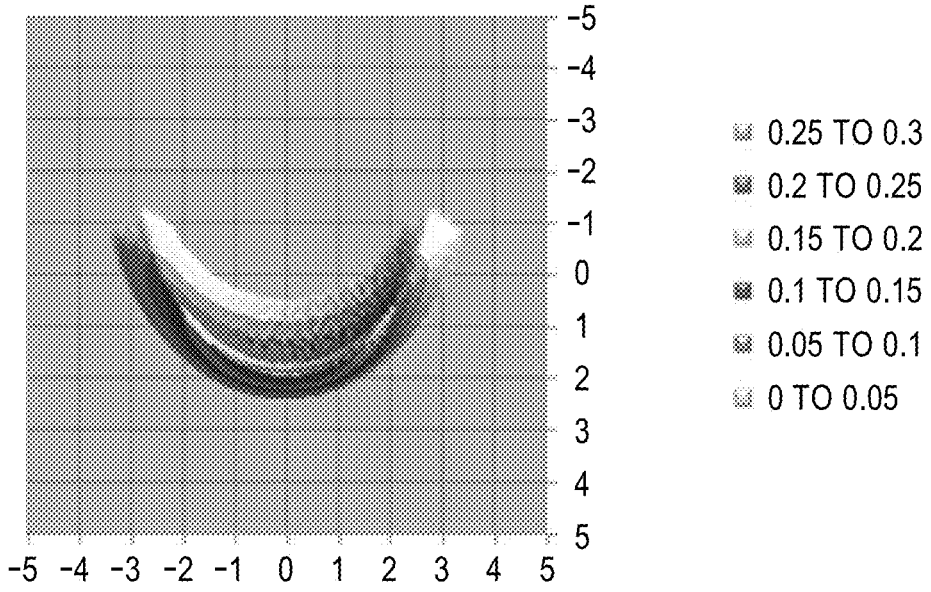
FIG. 5A is an illumination distribution on an illuminated surface obtained by the illumination optical system according to the first embodiment at the time of the nominal arrangement.
Figure 5B:
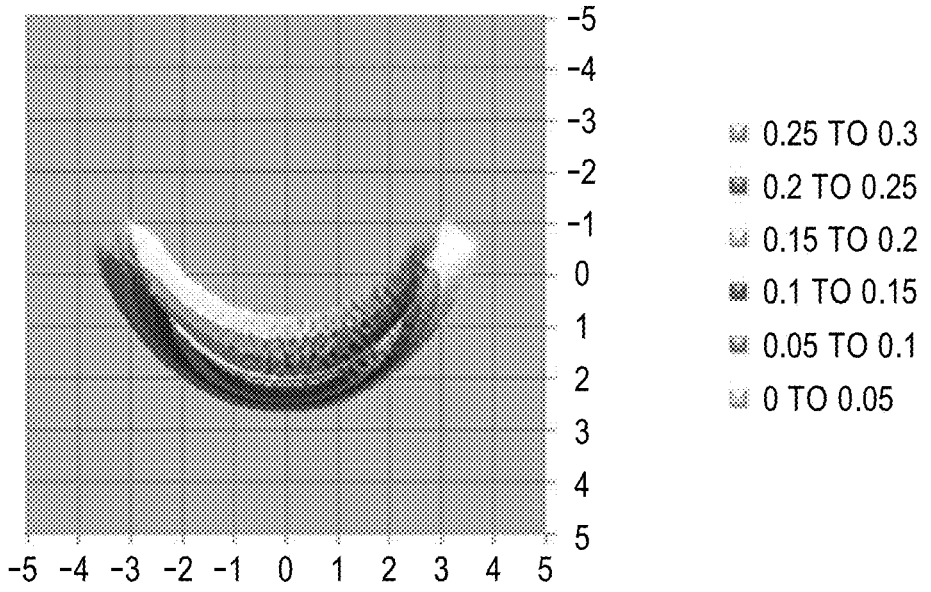
FIG. 5B is an illumination distribution on the illuminated surface obtained by the illumination optical system according to the first embodiment at the time of the non-nominal arrangement.

FIG. 5A and FIG. 5B are illumination distributions on the illuminated surface 120 obtained by the illumination optical system 10 according to the first embodiment at the time of the light source nominal arrangement and at the time of the light source non-nominal arrangement, respectively. The vertical axis represents the X direction, and the lateral axis represents the Y direction. In this case, the light source nominal arrangement means an arrangement in which the center of the light emitting surface of the LED 100 is arranged at coordinates (X, Y, Z)=(1, 0, −14) shown in Table 1. Further, as the light source non-nominal arrangement, a case where the LED 100 is arranged at coordinates (X, Y, Z)=(1, 0, −14.1) is exemplified.

Further, the values shown in FIG. 5A and FIG. 5B are light amount densities for 1 $mm^2$ when the amount of light illuminating the illuminated surface 120 at the time of the light source nominal arrangement is normalized to 1.

In this case, a position at which, when the LED 100 is arranged at the nominal arrangement, the detection unit (not shown) can detect the light amount of the light flux illuminating the illuminated surface at the highest efficiency is referred to as a detection center position (see Table 1), and the area of 0.2 mm×0.2 mm about the detection center position is referred to as a detection area.

In other words, the detection center position refers to a position at which, when the LED 100 is arranged at the nominal arrangement, the sum of the light amount of the light flux illuminating the detection area (0.2 mm×0.2 mm) on the illuminated surface is the largest.

At this time, referring to FIG. 5A and FIG. 5B, the detected light amount at the time of the light source non-nominal arrangement is 76% of the detected light amount at the time of the light source nominal arrangement. Therefore, it is understood that, in the illumination optical system 10 according to this embodiment, even when the light source nominal arrangement is changed to the light source non-nominal arrangement, the light amount (detected light amount) of the light flux illuminating the detection area on the illuminated surface 120 is not sharply decreased.

The detected light amount herein refers to a light amount detected by the detection unit (not shown) with respect to the light amount of the light flux illuminating the illuminated surface 120.

Figure 6A:
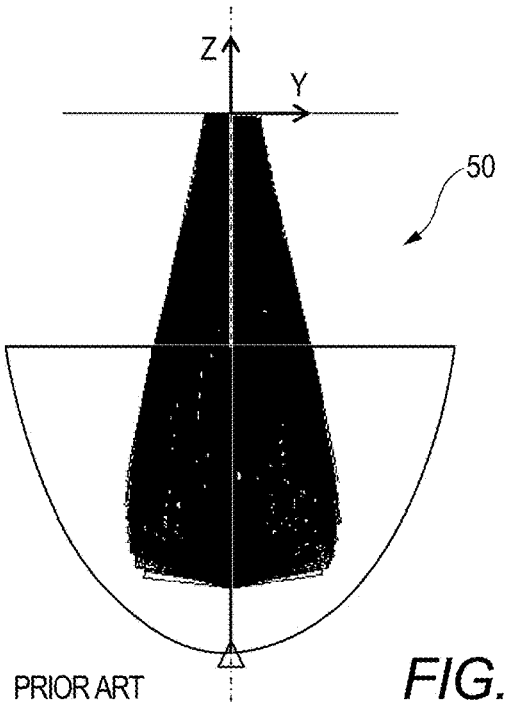
FIG. 6A is a YZ sectional view of a related-art illumination optical system.
Figure 6B:
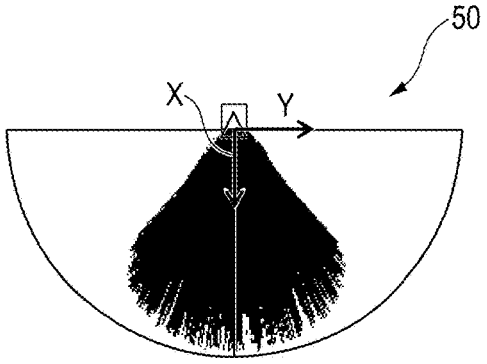
PRIOR ART FIG. 6B
FIG. 6B is an XY sectional view of the related-art illumination optical system.
Figure 6C:
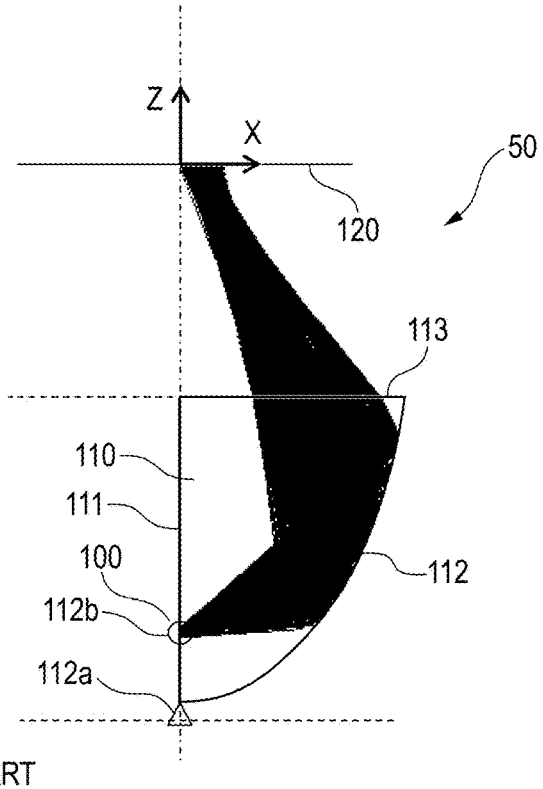
PRIOR ART FIG. 6C
FIG. 6C is an XZ sectional view of the related-art illumination optical system.

FIG. 6A, FIG. 6B, and FIG. 6C are a YZ sectional view, an XY sectional view, and an XZ sectional view, respectively, of a related-art illumination optical system 50.

In Table 2 below, optical design values of the related-art illumination optical system 50 are shown.

TABLE 2

Optical design values of related-art illumination optical system 50

| | Symbol | Value |
|---|---|---|
| LED dominant wavelength | λ | 780 nm |
| Refractive index | n(λ) | 1.49361 |
| Ellipsoidal aspheric surface coefficient | R | 4.00328 |
| | K | −0.67186 |
| Light source main exit angle | θ | 90 |
| Separation amount between focal point and light source (mm) | Δ | 0 |
| Maximum value of separation amount between focal point and light source (mm) | Δmax | 4.003 |
| Ellipsoidal reflection surface magnification | β | 5.1 |
| Light source main incident angle | φ | 39.3 |
| Critical angle | φm | 42.0 |

| | Coordinate | | | Tilt (surface normal direction) | | |
|---|---|---|---|---|---|---|
| | X | Y | Z | TiltX | TiltY | TiltZ |
| LED light emitting surface center position | 0 | 0 | −14 | — | — | — |
| Incident surface | 0 | 0 | −14 | — | 90 | 0 |
| Ellipsoidal reflection surface vertex | 0 | 0 | −16.2 | 90 | 0 | — |
| Ellipsoidal reflection surface light-source-side focal point | 0 | 0 | −14 | — | — | — |
| Exit surface | 0 | 0 | −7 | 90 | 0 | — |
| Illuminated surface | 0 | 0 | 0 | 0 | 0 | — |
| Detection center position | 0.5 | 0 | 0 | — | — | — |

TABLE 2-continued

The related-art illumination optical system 50 includes like components as those of the illumination optical system 10 according to the first embodiment, and hence the components are denoted by like reference symbols to omit the description thereof. The related-art illumination optical system 50 differs from the illumination optical system 10 according to the first embodiment in that the center of the light emitting surface of the LED 100 is arranged at the position (X, Y, Z)=(0, 0, −14) of the light-source-side focal point 112*b* of the ellipsoidal reflection surface 112. Further, along therewith, the vertex coordinates of the incident surface 111 of the light guiding member 110 are changed.

Figure 7A:
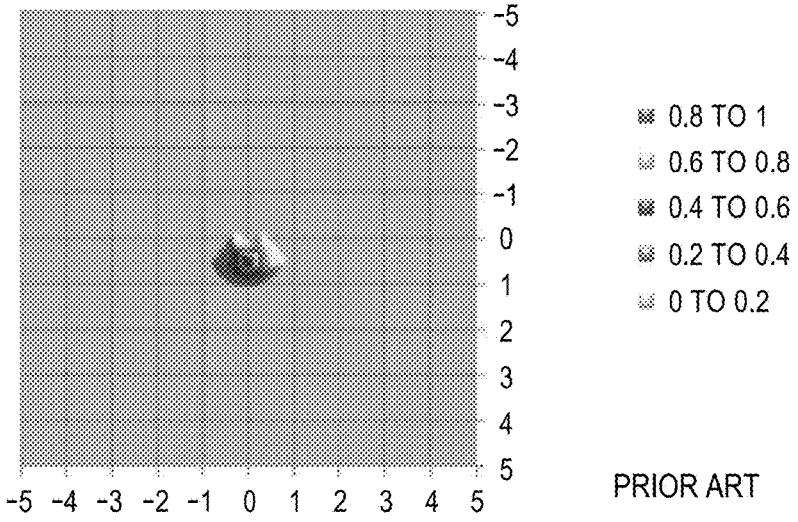
FIG. 7A is an illumination distribution on an illuminated surface obtained by the related-art illumination optical system at the time of the nominal arrangement.
Figure 7B:
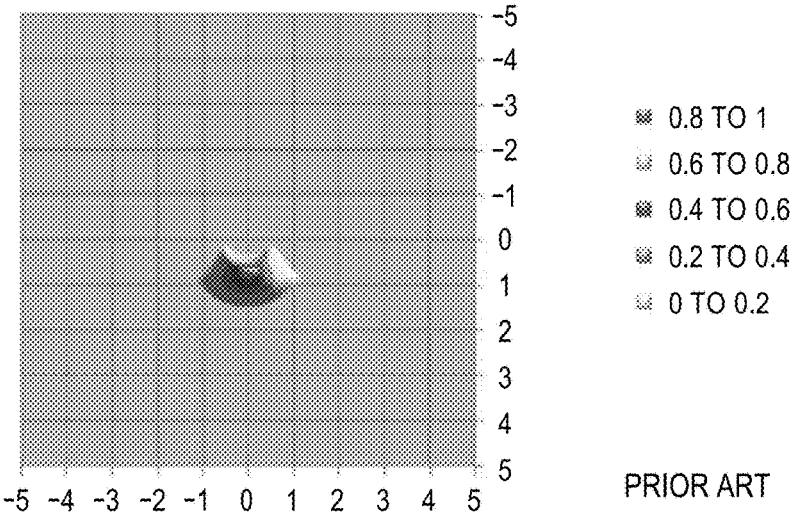
PRIOR ART FIG. 7B
FIG. 7B is an illumination distribution on the illuminated surface obtained by the related-art illumination optical system at the time of the non-nominal arrangement.

FIG. 7A and FIG. 7B are illumination distributions on the illuminated surface 120 obtained by the related-art illumination optical system 50 at the time of the light source nominal arrangement and at the time of the light source non-nominal arrangement, respectively. The vertical axis represents the X direction, and the lateral axis represents the Y direction. In this case, the light source nominal arrangement means an arrangement in which the center of the light emitting surface of the LED 100 is arranged at coordinates (X, Y, Z)=(0, 0, −14) shown in Table 2. Further, as the light source non-nominal arrangement, a case where the center of the light emitting surface of the LED 100 is arranged at coordinates (X, Y, Z)=(0, 0, −14.1) is exemplified.

Further, the values shown in FIG. 7A and FIG. 7B are light amount densities for 1 $mm^2$ when the amount of light illuminating the illuminated surface 120 at the time of the light source nominal arrangement is normalized to 1.

In this case, a position at which, when the LED 100 is arranged at the nominal arrangement, the detection unit (not shown) can detect the light amount of the light flux illuminating the illuminated surface at the highest efficiency is referred to as the detection center position (see Table 2), and the area of 0.2 mm×0.2 mm about the detection center position is referred to as the detection area.

At this time, referring to FIG. 7A and FIG. 7B, the detected light amount at the time of the light source non-nominal arrangement is 22% of the detected light amount at the time of the light source nominal arrangement. Therefore, it is understood that, in the related-art illumination optical system 50, when the light source nominal arrangement is changed to the light source non-nominal arrangement, the detected light amount is sharply decreased.

From the above, when the illumination optical system according to this embodiment is applied to a product, increase in productivity during manufacture and reduction in performance variation in each product can be achieved.

In the illumination optical system 10 according to this embodiment, the light source is arranged at a position shifted from the light-source-side focal point of the ellipsoidal reflection surface in a direction perpendicular to the light emitting surface (X direction). However, as long as the light source is arranged so as to be separated in a direction having a component perpendicular to the light emitting surface of the light source (direction non-parallel to the light emitting surface of the light source), the effects of the present invention are exerted. In other words, as long as the light source is arranged so as to be separated in a direction perpendicular to a plane including the light emitting surface of the light source, the effects of the present invention are exerted.

Further, in the illumination optical system 10 according to this embodiment, the focal point of the ellipsoidal reflection surface 112 is present outside of the light guiding member 110.

With this, as compared to the illumination optical system in which the focal point of the ellipsoidal reflection surface is present inside or on the surface of the light guiding member, an effect that the light guiding member can be downsized can be obtained.

Further, in the illumination optical system 10 according to this embodiment, the incident surface 111 of the light guiding member 110, to which the LED 100 is arranged close, is arranged so as to be parallel to the major axis of the ellipsoidal reflection surface 112 (major axis of the spheroid forming the ellipsoidal reflection surface 112).

With this, when the height of the ellipsoidal reflection surface 112 is measured in a cross section perpendicular to the major-axis direction of the ellipsoidal reflection surface 112 with the incident surface 111 of the light guiding member 110 being a base surface, a circle shape is obtained. Therefore, such an effect that the shape can be easily analyzed can be obtained.

Second Embodiment

Figure 8A:
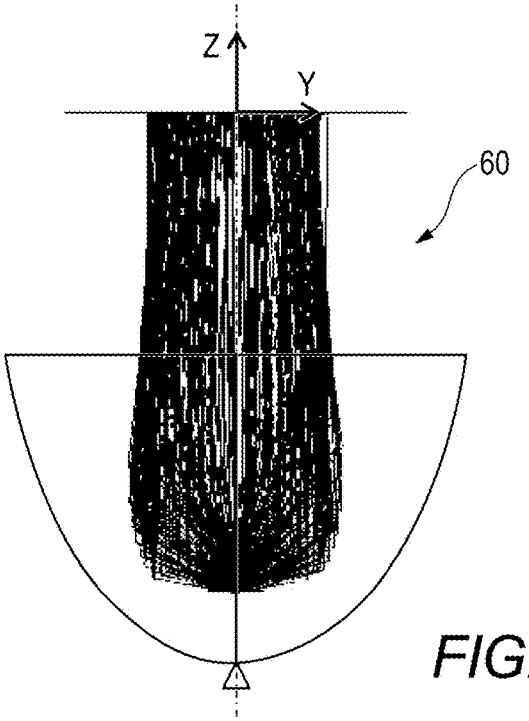
FIG. 8A is a YZ sectional view of an illumination optical system according to a second embodiment of the present invention.
Figure 8B:
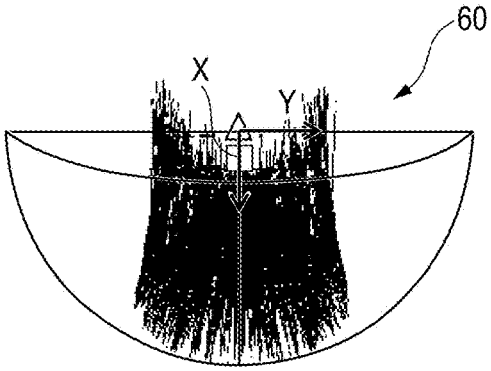
FIG. 8B is an XY sectional view of the illumination optical system according to the second embodiment.
Figure 8C:
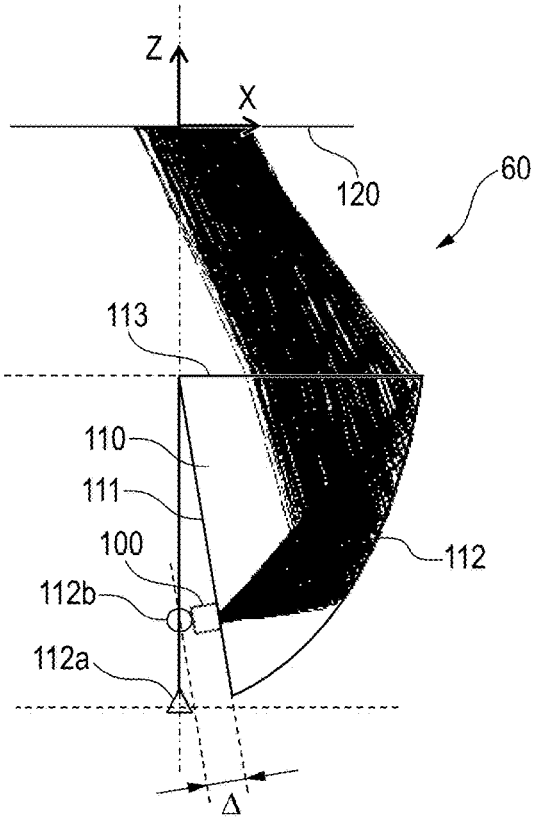
FIG. 8C is an XZ sectional view of the illumination optical system according to the second embodiment.

FIG. 8A, FIG. 8B, and FIG. 8C are a YZ sectional view, an XY sectional view, and an XZ sectional view, respectively, of an illumination optical system 60 according to a second embodiment of the present invention.

In Table 3 below, optical design values of the illumination optical system 60 according to the second embodiment are shown.

TABLE 3

Optical design values of illumination optical system 60 according to second embodiment

| | Symbol | Value |
|---|---|---|
| LED dominant wavelength | λ | 780 nm |
| Refractive index | n(λ) | 1.49361 |
| Ellipsoidal aspheric surface coefficient | R | 4.00328 |
| | K | −0.67186 |
| Light source main exit angle | θ | 99.46 |
| Separation amount between focal point and light source (mm) | Δ | 1 |
| Maximum value of separation amount between focal point and light source (mm) | Δmax | 4.627 |
| Ellipsoidal reflection surface magnification | β | 4.3 |
| Light source main incident angle | φ | 43.1 |
| Critical angle | φm | 42.0 |

| | Coordinate | | | Tilt (surface normal direction) | | |
|---|---|---|---|---|---|---|
| | X | Y | Z | TiltX | TiltY | TiltZ |
| LED light emitting surface center position | 0.986 | 0 | −13.836 | — | — | — |
| Incident surface | 0.986 | 0 | −13.836 | — | 80.54 | 0 |
| Ellipsoidal reflection surface vertex | 0 | 0 | −16.2 | 90 | 0 | — |
| Ellipsoidal reflection surface light-source-side focal point | 0 | 0 | −14 | — | — | — |
| Exit surface | 0 | 0 | −7 | 90 | 0 | — |
| Illuminated surface | 0 | 0 | 0 | 0 | 0 | — |
| Detection center position | 1.6 | 0 | 0 | — | — | — |

The illumination optical system 60 according to the second embodiment includes like components as those of the illumination optical system 10 according to the first embodiment, and hence the components are denoted by like reference symbols to omit the description thereof. The illumination optical system 60 according to the second embodiment differs from the illumination optical system 10 according to the first embodiment in that the incident surface 111 is inclined by an angle of 9.46° with respect to the YZ plane.

With such a configuration, the degree of freedom of a relative arrangement relationship between the light source 100 and the illuminated surface 120 can be obtained. Further, a general LED has the largest light distribution intensity in the normal direction to the light emitting surface, and hence the illumination efficiency can be developed by causing the light flux in the normal direction to be easily reflected by the ellipsoidal reflection surface 112.

Figure 9A:
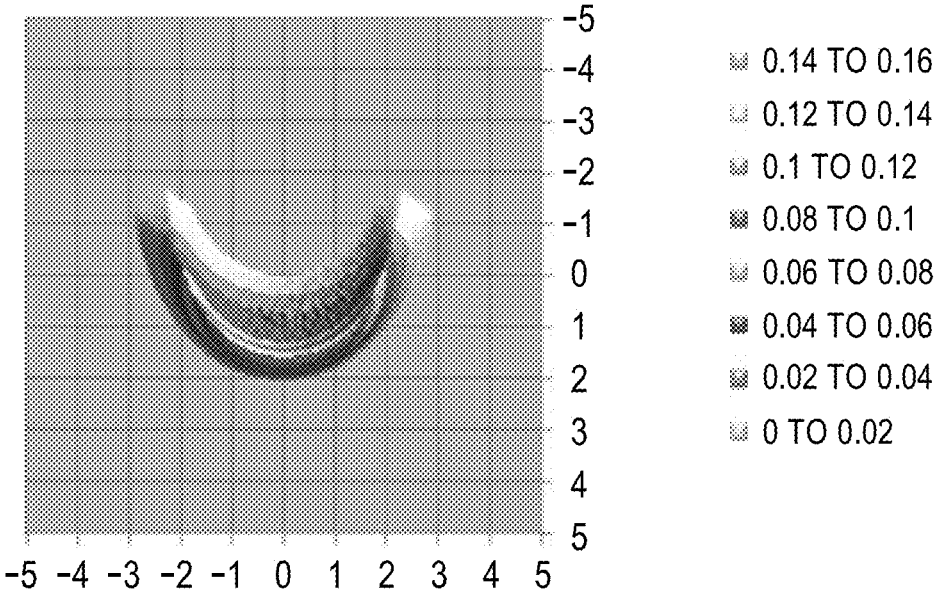
FIG. 9A is an illumination distribution on an illuminated surface obtained by the illumination optical system according to the second embodiment at the time of the nominal arrangement.
Figure 9B:
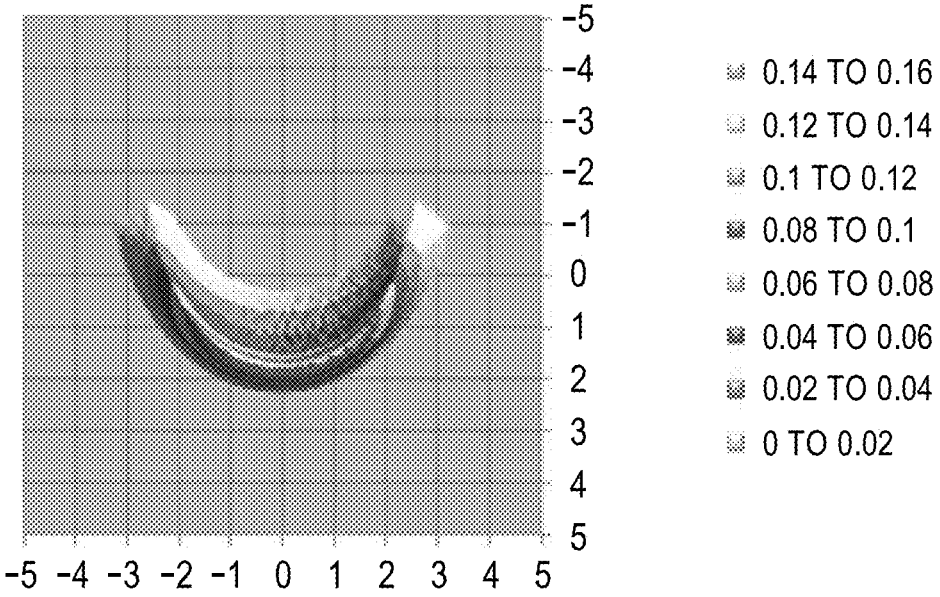
FIG. 9B is an illumination distribution on the illuminated surface obtained by the illumination optical system according to the second embodiment at the time of the non-nominal arrangement.

FIG. 9A and FIG. 9B are illumination distributions on the illuminated surface 120 obtained by the illumination optical system 60 according to the second embodiment at the time of the light source nominal arrangement and at the time of the light source non-nominal arrangement, respectively. The vertical axis represents the X direction, and the lateral axis represents the Y direction. In this case, the light source nominal arrangement means an arrangement in which the center of the light emitting surface of the LED 100 is arranged at coordinates (X, Y, Z)=(0.986, 0, −13.836) shown in Table 3. That is, the LED 100 is arranged so as to be separated by Δ=1 mm from the light-source-side focal point 112*b* in the normal direction to the light emitting surface of the LED 100. Further, the light source non-nominal arrangement means such an arrangement that the center of the light emitting surface of the LED 100 is arranged so as to be shifted from the nominal position within the XZ plane along the incident surface 111 so as to approach the ellipsoidal reflection surface 112 by 0.1 mm. That is, the light source non-nominal arrangement means that the center of the light emitting surface of the LED 100 is arranged at coordinates (X, Y, Z)=(1.002, 0, −13.934).

Further, the values shown in FIG. 9A and FIG. 9B are light amount densities for 1 $mm^2$ when the amount of light illuminating the illuminated surface 120 at the time of the light source nominal arrangement is normalized to 1.

In this case, a position at which, when the LED 100 is arranged at the nominal arrangement, the detection unit (not shown) can detect the light amount of the light flux illuminating the illuminated surface at the highest efficiency is referred to as the detection center position (see Table 3), and the area of 0.2 mm×0.2 mm about the detection center position is referred to as the detection area.

In other words, the detection center position refers to a position at which, when the LED 100 is arranged at the nominal arrangement, the sum of the light amount of the light flux illuminating the detection area (0.2 mm×0.2 mm) on the illuminated surface is the largest.

At this time, it is found from FIG. 9A and FIG. 9B that the detected light amount at the time of the light source non-nominal arrangement is 60% of the detected light amount at the time of the light source nominal arrangement.

Therefore, it is understood that, in the illumination optical system 60 according to this embodiment, even when the light source nominal arrangement is changed to the light source non-nominal arrangement, the light amount (detected light amount) of the light flux illuminating the detection area on the illuminated surface 120 is not sharply decreased.

As described above, in the illumination optical system 60 according to this embodiment, the incident surface 111 of the light guiding member 110 is arranged so as to be non-parallel to the major axis of the ellipsoidal reflection surface 112. With this, the degree of freedom of the relative arrangement relationship between the LED 100 and the illuminated surface 120 can be obtained.

Further, when the non-parallel angle of the incident surface 111 with respect to the major axis of the ellipsoidal reflection surface 112 is adjusted, a light flux in the normal direction to the light emitting surface, which has a large intensity in the light distribution of the LED 100, can be easily totally reflected by the ellipsoidal reflection surface 112, and the efficiency of the light flux illuminating the illuminated surface can be increased.

Next, the separation amount Δ between the light source and the light-source-side focal point of the ellipsoidal reflection surface is considered.

The size of the illumination optical system is substantially determined based on the arrangement relationship between the light source and the illuminated surface. Further, considering the size of the illumination optical system and the size limitation on the light guiding member, the shape and the size of the ellipsoidal reflection surface are approximately determined. Further, the angle of the light guiding member incident surface of the light guiding member with respect to the major axis of the ellipsoidal reflection surface is also similarly determined.

The arrangement error of the light source, which becomes a problem in the illumination optical system according to this embodiment, is substantially proportional to the size of the illumination optical system, in particular, the size of the light guiding member.

That is, in general, as the illumination optical system, in particular, the light guiding member is increased in size, the arrangement error of the light source is increased. Conversely, as the illumination optical system, in particular, the light guiding member is decreased in size, the arrangement error of the light source is decreased.

This is because the method of assembling the illumination optical system differs depending on the size of the illumination optical system, in particular, the size of the light guiding member.

That is, an appropriate separation amount Δ is required to be considered depending on the size of the illumination optical system, in particular, the size of the light guiding member.

Figure 10A:
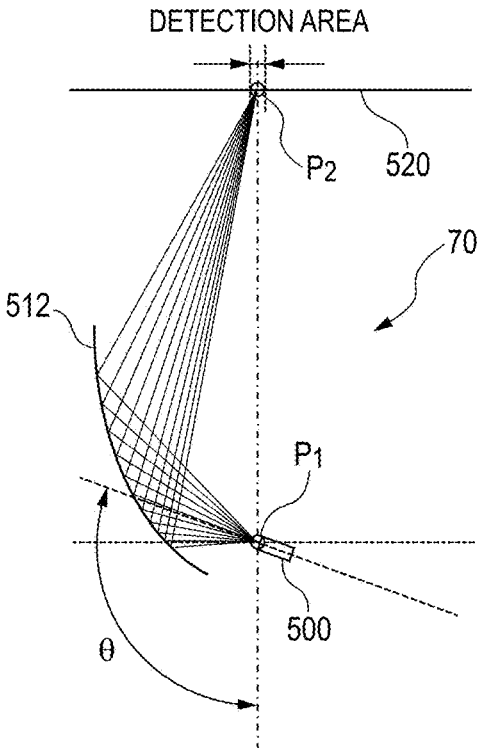
FIG. 10A is an XZ sectional view of an illumination optical system according to the present invention when a separation amount $\Delta$ is 0.
Figure 10B:
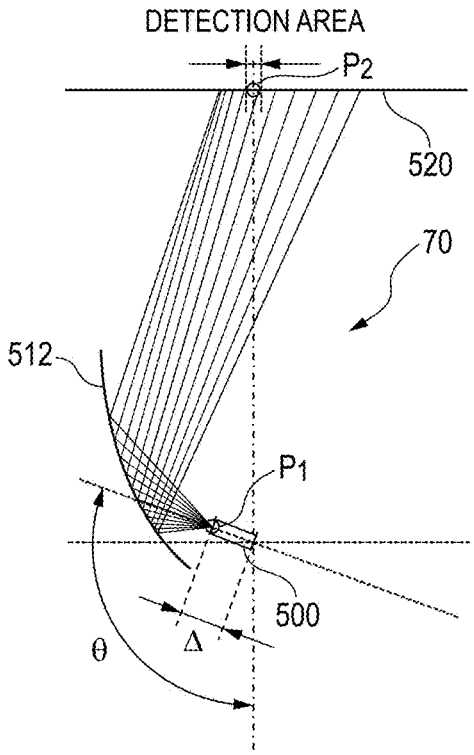
FIG. 10B is an XZ sectional view of the illumination optical system according to the present invention when the separation amount $\Delta$ is a predetermined amount.
Figure 10C:
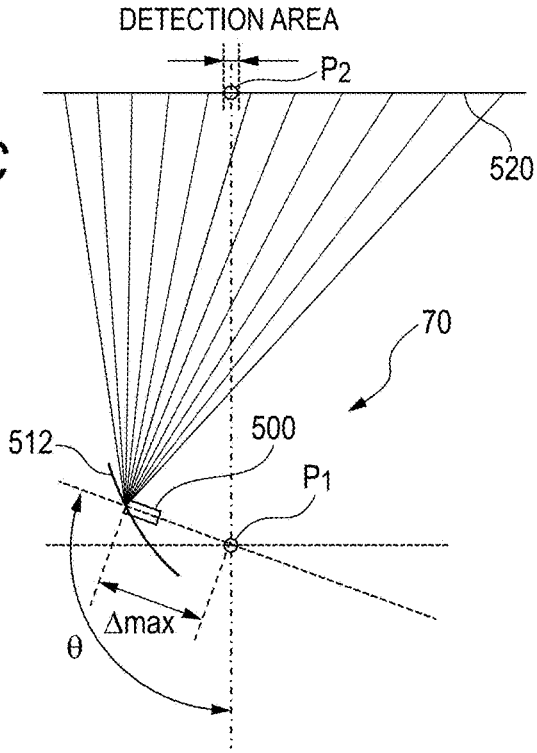
FIG. 10C is an XZ sectional view of the illumination optical system according to the present invention when the separation amount Δ is $\Delta_{max}$.

FIG. 10A, FIG. 10B, and FIG. 10C are XZ sectional views of an illumination optical system 70 in various separation amounts Δ.

Specifically, FIG. 10A is an illustration of a case where a light source 500 is arranged on one focal point $P_1$ of an ellipsoidal reflection surface 512 (that is, Δ=0). Further, FIG. 10B is an illustration of a case where the light source 500 is shifted by a predetermined distance Δ from the one focal point $P_1$ of the ellipsoidal reflection surface 512. Further, FIG. 10C is an illustration of a case where the light source 500 is arranged on the ellipsoidal reflection surface 512 (that is, $\Delta=\Delta_{max}$).

An illuminated surface 520 is arranged so as to be parallel to the XY plane, and to include another focal point $P_2$ of the ellipsoidal reflection surface 512.

As illustrated in FIG. 10A to FIG. 10C, the normal direction to the light emitting surface of the light source 500 is inclined so as to form an angle of θ with respect to the major axis of the ellipsoidal reflection surface 512.

The light flux emitted from the light source 500, which has a predetermined divergence angle, is reflected by the ellipsoidal reflection surface 512, and is illuminated onto the focal point $P_2$ on the illuminated surface 520 or the periphery thereof.

Specifically, as the separation amount Δ is increased, light is illuminated around the focal point $P_2$ on the illuminated surface 520 while the light collecting degree is significantly degraded.

Therefore, the highest light collecting degree is obtained at the time of Δ=0, and the lowest light collecting degree is obtained at the time of $\Delta=\Delta_{max}$. Of course, $\Delta>\Delta_{max}$ cannot be satisfied, that is, the light source 500 cannot be arranged beyond the ellipsoidal reflection surface 512.

Further, as is clear from the discussion above, as the separation amount Δ is increased, even when the light source nominal arrangement is changed to the light source non-nominal arrangement, sharp reduction in light amount (detected light amount) of the light flux illuminating the detection area on the illuminated surface 520 is less liable to occur.

However, when the separation amount Δ is excessively large, the light amount (detected light amount) itself of the light flux illuminating the detection area on the illuminated surface 520 is decreased.

From the above, in the present invention, the separation amount Δ is preferred to satisfy the following relationship.

$$0.1\Delta_{max}\leq\Delta\leq0.5\Delta_{max}$$

For the sake of convenience, the illumination optical system 70 is described as an illumination optical system not including a solid light guiding member, but the principle of this discussion is not affected even with an illumination optical system including a solid light guiding member.

Next, derivation of $\Delta_{max}$ is described.

Figure 11:
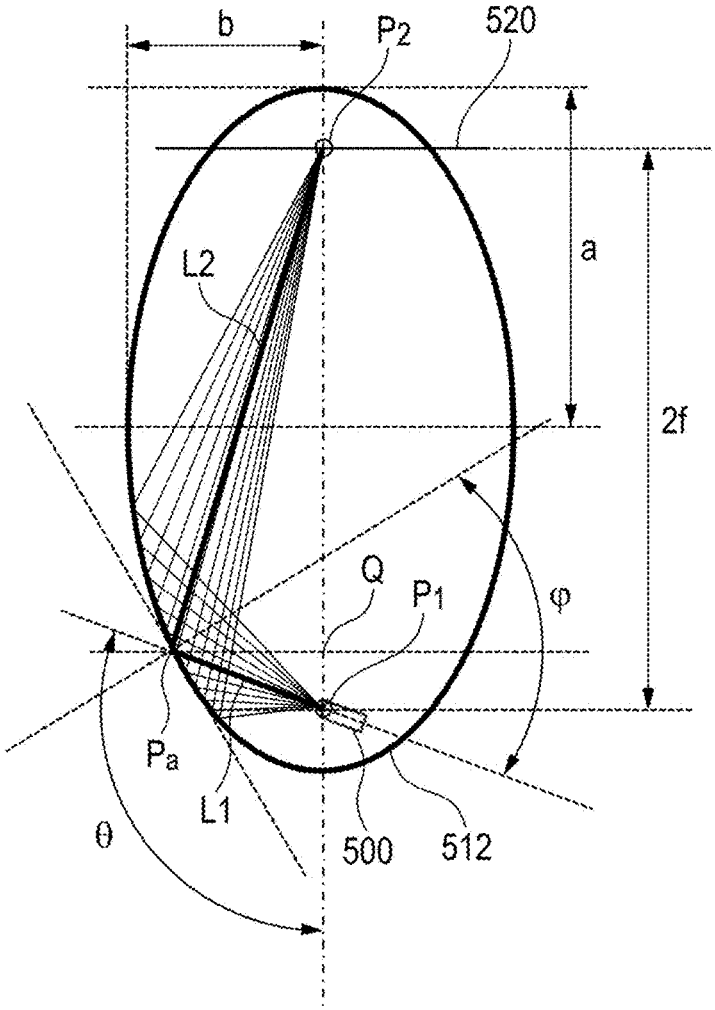
FIG. 11 is a geometric schematic view of an illumination optical system according to the embodiment.

FIG. 11 is a geometric schematic view of the illumination optical system 70.

First, a distance 2*f* between the light-source-side focal point $P_1$ and the illuminated-surface-side focal point $P_2$ of the ellipsoidal reflection surface 512 is represented by Expression (2) with use of a semi-major axis a and a semi-minor axis b of the ellipsoidal reflection surface 512.

$$2f=2\sqrt{a^2-b^2} \tag{2}$$

Next, an intersection between the ellipsoidal reflection surface 512 and the light flux emitted from the focal point $P_1$ with an angle θ (0°≤θ≤180°) with respect to the major axis of the ellipsoidal reflection surface 512 is represented by $P_a$.

At this time, when a distance from the focal point $P_1$ to the intersection $P_a$ is represented by L1, and a distance from the intersection $P_a$ to the focal point $P_2$ is represented by L2, the relationship represented by Expression (3) can be obtained based on the nature of an ellipse.

$$L1+L2=2a \tag{3}$$

Therefore, based on Expression (3), Expression (4) can be obtained.

$$L2=2a-L1 \tag{4}$$

Next, when an intersection obtained by drawing a perpendicular line from the intersection $P_a$ to the major axis of the ellipsoidal reflection surface 512 is represented by Q, a distance between the intersection $P_a$ and the intersection Q is L1 sin θ, and a distance between the intersection Q and the focal point $P_2$ is 2f+L1 cos θ.

Therefore, based on the Pythagorean theorem of a right triangle $P_aQP_2$, L1 can be calculated as follows.

$$\begin{aligned}
&(L2)^2 = (2f + L1\cos\theta)^2 + (L1\sin\theta)^2 \\
&(2a - L1)^2 = \left(2\sqrt{a^2 - b^2} + L1\cos\theta\right)^2 + (L1\sin\theta)^2 \\
&4a^2 - 4aL1 + L1^2 = \\
&\quad 4a^2 - 4b^2 + 4\sqrt{a^2 - b^2}\,L1\cos\theta + L1^2\cos^2\theta + L1\sin^2\theta - 4aL1 = \\
&\qquad -4b^2 + 4\sqrt{a^2 - b^2}\,L1\cos\theta \\
&\left(a + \sqrt{a^2 - b^2}\cos\theta\right)L1 = b^2 \\
&\therefore L1 = \frac{b^2}{a + \sqrt{a^2 - b^2}\cos\theta}
\end{aligned}$$

Further, the semi-major axis a and the semi-minor axis b of the ellipsoidal reflection surface 512 are represented by Expression (5) with use of the paraxial curvature radius R and the conic constant k of the ellipsoidal reflection surface 512.

$$\begin{aligned}
a &= \frac{R}{k+1} \\
b^2 &= \frac{R^2}{k+1}
\end{aligned} \tag{5}$$

Therefore, L1 can be rewritten as follows with use of Expression (5).

$$\begin{aligned}
L1 &= \frac{\dfrac{R^2}{k+1}}{\dfrac{R}{k+1} + \sqrt{\dfrac{R^2}{(k+1)^2} - \dfrac{R^2}{k+1}}\cos\theta} \\
&= \frac{\dfrac{R^2}{k+1}}{\dfrac{R}{k+1} + \dfrac{R}{k+1}\sqrt{1-(k+1)}\cos\theta} \\
&= \frac{R}{1 + \sqrt{1-(k+1)}\cos\theta}
\end{aligned}$$

Then, $\Delta_{max}$=L1 is satisfied, and hence Expression (6) can be obtained.

$$\Delta_{max} = \frac{R}{1 + \sqrt{1-(k+1)}\cos\theta} \tag{6}$$

In this case, when $\Delta_{max}$ is calculated in the illumination optical system 60 according to the second embodiment, referring to Table 3, R=4.00328, k=−0.67186, and θ=99.46° are obtained, and hence $\Delta_{max}$ is determined as 4.627 mm.

The separation amount Δ in the illumination optical system 60 according to the second embodiment is set to 1 mm, and hence it is understood that the separation amount Δ satisfies the relationship of $0.1\Delta_{max} \le \Delta \le 0.5\Delta_{max}$ described above.

Next, the configuration of the ellipsoidal reflection surface in this embodiment is considered.

A lateral magnification β of the illumination optical system according to this embodiment can be approximately represented by a ratio between a distance between the light source and the ellipsoidal reflection surface along a travel direction of the light flux and a distance between the ellipsoidal reflection surface and the illuminated surface along the travel direction of the light flux.

That is, the lateral magnification β is represented by Expression (7) in the illumination optical system illustrated in FIG. 11.

$$\begin{aligned}
\beta &\approx \frac{L2}{L1} \\
&= \frac{2a - L1}{L1} \\
&= \frac{\dfrac{2R}{k+1} - L1}{L1} \\
&= \frac{2R}{(k+1)L1} - 1
\end{aligned} \tag{7}$$

When the imaging optical system is considered as in a general one, a shift amount δ in a defocus direction of the light collecting position on the illuminated surface side can be represented by (separation amount Δ between light source and light-source-side focal point)×(longitudinal magnification $\beta^2$). Therefore, as the lateral magnification β is increased, the light collecting position on the illuminated surface side is shifted, and the light flux illuminates a wide area on the illuminated surface.

In the illumination optical system according to this embodiment, the light source is arranged so as to be shifted from the position of the light-source-side focal point of the ellipsoidal reflection surface, but even when the position of the illuminated surface is shifted from the light collecting position, the effects of the present invention can be obtained.

However, when the illuminated surface is shifted to the opposite side of the light guiding member, the illumination optical system may be increased in size. When the illuminated surface is shifted to the light guiding member side, the interference between the illuminated surface and the light guiding member becomes a problem.

That is, rather than shifting the position of the illuminated surface from the light collecting position, it is preferred to shift the light source from the position of the light-source-side focal point of the ellipsoidal reflection surface, to thereby shift the illuminated position from the light collecting position.

Therefore, in this embodiment, in order to achieve an illumination optical system configured to illuminate a comparable wide area on the illuminated surface, a configuration in which the light source is shifted from the position of the light-source-side focal point of the ellipsoidal reflection surface is more effective than a configuration in which the position of the illuminated surface is shifted from the light collecting position. Further, it is preferred to employ a configuration in which the shift amount corresponding to the illuminated surface or the light source is suppressed to be small.

Specifically, a configuration satisfying $\beta>1$ may be employed. That is, when Expression (8) is satisfied, as compared to the configuration in which the position of the illuminated surface is shifted from the light collecting position, the configuration in which the light source is shifted from the position of the light-source-side focal point of the ellipsoidal reflection surface can significantly obtain the effects of the present invention.

$$\beta \approx \frac{2R}{(k+1)/L1} - 1 > 1 \tag{8}$$

Further, based on L1=$\Delta_{max}$, Expression (8) can be rewritten as Expression (9).

$$\beta \approx \frac{2R}{(k+1)\Delta_{max}} - 1 > 1 \tag{9}$$

In a strict sense, the distance between the ellipsoidal reflection surface and the illuminated surface along the travel direction of the light flux also depends on the shape of the exit surface of the light guiding member, and hence the distance differs from L2. However, upon discussion of the configuration of the ellipsoidal reflection surface relating to the effects of the present invention, Expression (8) may be approximately used without a problem.

Similarly to the above, when $\beta$ is calculated in the illumination optical system 60 according to the second embodiment, referring to Table 3, R=4.00328, k=−0.67186, and L1=4.627 mm are obtained, and hence $\beta$ is determined as 4.3.

Therefore, it is understood that the ellipsoidal reflection surface lateral magnification $\beta$ in the illumination optical system 60 according to the second embodiment satisfies the relationship of Expression (8).

Further, as described above, the shift amount $\delta$ in the defocus direction of the light collecting position on the illuminated surface side is proportional to the longitudinal magnification $\beta^2$.

Therefore, when, as in the illumination optical system 60 according to the second embodiment, the ellipsoidal reflection surface is provided such that the lateral magnification $\beta$ satisfies 2 or more (longitudinal magnification $\beta^2$ satisfies 4 or more), the effects of the present invention can be more remarkably obtained.

Next, a condition for the light flux emitted from the light source to be totally reflected by the ellipsoidal reflection surface is considered.

In FIG. 11, when an incident angle at which the light flux emitted from the light source enters the ellipsoidal reflection surface is represented by $\varphi$, $\angle P_1_P_a_P_2=2\varphi$ is obtained.

In this case, the incident angle $\varphi$ is defined as an angle between the emission direction of the light source and a direction perpendicular to the tangent of the ellipsoidal reflection surface at the intersection $P_a$ between the emission direction of the light source and the ellipsoidal reflection surface.

The incident angle $\varphi$ can be determined as in Expression (10) with use of the cosine theorem in a triangle $P_1_P_a_P_2$.

$$\begin{aligned}(2f)^2 &= (L1)^2 + (L2)^2 - 2L1L2\cos(2\phi)\left(2\sqrt{a^2-b^2}\right)^2 = \\ &L1^2 + (2a-L1)^2 - 2L1(2a-L1)\cos(2\phi)4a^2 - 4b^2 = \\ &L1^2 + 4a^2 - 4aL1 + L1^2 - 2L1(2a-L1)\cos(2\phi) - 2b^2 = \\ &L1^2 - 2aL1 - L1(2a-L1)\cos(2\phi)\end{aligned} \tag{10}$$

$$\begin{aligned}\cos(2\phi) &= \frac{-L1(2a-L1)+2b^2}{L1(2a-L1)} \\ &= \frac{2b^2}{L1(2a-L1)} - 1 \\ &= \frac{2\frac{R^2}{k+1}}{L1\left(2\frac{R}{k+1} - L1\right)} - 1 \\ &= \frac{2R^2}{L1[2R-(k+1)L1]} - 1\end{aligned}$$

$$\therefore \phi = \frac{1}{2}\arccos\left\{\frac{2R^2}{L1[2R-(k+1)L1]} - 1\right\}$$

Therefore, when the refractive index of the light guiding member is represented by n, and the critical angle thereof is represented by $\varphi_m$, the total reflection condition of the light flux entering the ellipsoidal reflection surface at the incident angle $\varphi$ is determined as in Expression (11).

$$\begin{aligned}&\phi \geq \phi_m \\ &\therefore \frac{1}{2}\arccos\left\{\frac{2R^2}{L1[2R-(k+1)L1]} - 1\right\} \geq \arcsin\left(\frac{1}{n}\right)\end{aligned} \tag{11}$$

Therefore, when Expression (11) is satisfied, of the light fluxes emitted from the light source, the light flux in the normal direction to the light emitting surface, which has a particularly large intensity in light distribution, can be totally reflected by the ellipsoidal reflection surface, and the efficiency of the light flux illuminating the illuminated surface can be increased.

Similarly to the above, when $\varphi$ and $\varphi_m$ are calculated in the illumination optical system 60 according to the second embodiment, referring to Table 3, R=4.00328, k=−0.67186, L1=4.627 mm, and n=1.49361 are obtained, and hence $\varphi$ and $\varphi_m$ are determined as 43.1° and 42.0°, respectively.

Therefore, it is understood that the incident angle $\varphi$ in the illumination optical system 60 according to the second embodiment satisfies the relationship of Expression (11).

Third Embodiment

Figure 12A:
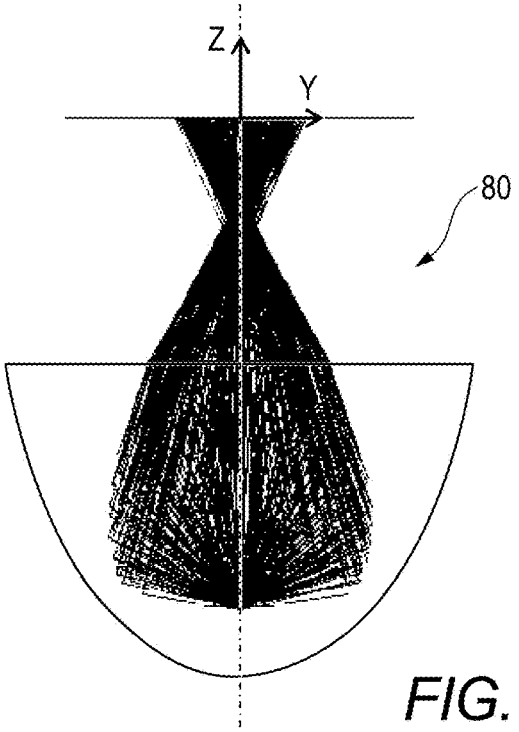
FIG. 12A is a YZ sectional view of an illumination optical system according to a third embodiment of the present invention.
Figure 12B:
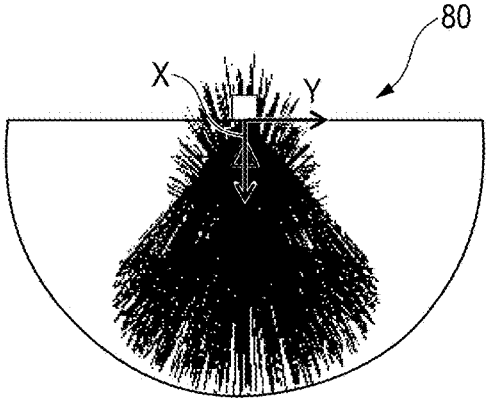
FIG. 12B is an XY sectional view of the illumination optical system according to the third embodiment.
Figure 12C:
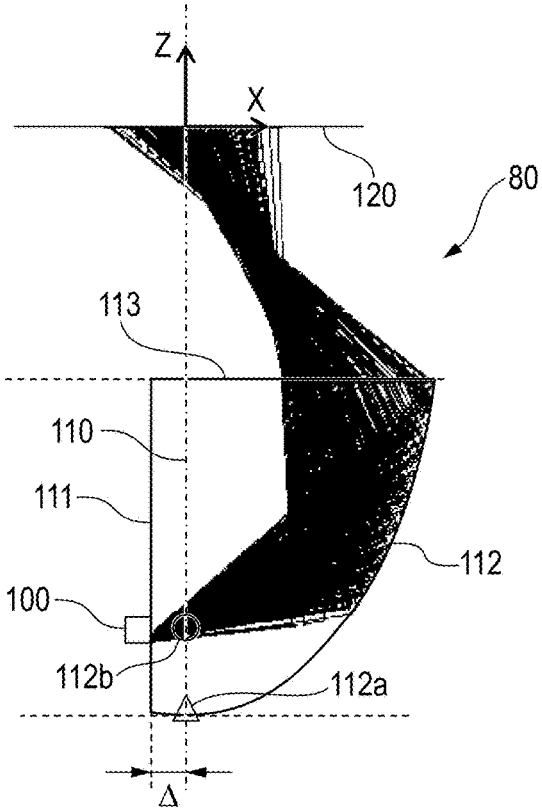
FIG. 12C is an XZ sectional view of the illumination optical system according to the third embodiment.

FIG. 12A, FIG. 12B, and FIG. 12C are a YZ sectional view, an XY sectional view, and an XZ sectional view, respectively, of an illumination optical system 80 according to a third embodiment of the present invention.

In Table 4 below, optical design values of the illumination optical system 80 according to the third embodiment are shown.

TABLE 4

Optical design values of illumination optical system 80 according to third embodiment

| | Symbol | Value |
|---|---|---|
| LED dominant wavelength | λ | 780 nm |
| Refractive index | n(λ) | 1.49361 |
| Ellipsoidal aspheric surface coefficient | R | 4.00328 |
| | K | −0.67186 |
| Light source main exit angle | θ | 90 |
| Separation amount between focal point and light source (mm) | Δ | 1 |
| Maximum value of separation amount between focal point and light source (mm) | Δmax | 4.003 |
| Ellipsoidal reflection surface magnification | β | 5.1 |
| Light source main incident angle | φ | 39.3 |
| Critical angle | φm | 42.0 |

| | Coordinate | | | Tilt (surface normal direction) | | |
|---|---|---|---|---|---|---|
| | X | Y | Z | TiltX | TiltY | TiltZ |
| LED light emitting surface center position | −1 | 0 | −14 | — | — | — |
| Incident surface vertex | −1 | 0 | −14 | — | 90 | 0 |
| Ellipsoidal reflection surface vertex | 0 | 0 | −16.2 | 90 | 0 | — |
| Ellipsoidal reflection surface light-source-side focal point | 0 | 0 | −14 | — | — | — |
| Exit surface vertex | 0 | 0 | −7 | 90 | 0 | — |
| Illuminated surface | 0 | 0 | 0 | 0 | 0 | — |
| Detection center position | −0.7 | 0 | 0 | — | — | — |

The illumination optical system 80 according to the third embodiment includes like components as those of the illumination optical system 10 according to the first embodiment, and hence the components are denoted by like reference symbols to omit the description thereof. The illumination optical system 80 according to the third embodiment differs from the illumination optical system 10 according to the first embodiment in that the position of the light source 100 is separated from the light-source-side focal point 112*b* of the ellipsoidal reflection surface 112 in a direction of separating from the ellipsoidal reflection surface 112. That is, in the configuration, the light-source-side focal point 112*b* of the ellipsoidal reflection surface 112 is provided inside of the light guiding member 110. Therefore, as compared to the illumination optical system 10 according to the first embodiment, the light guiding member 110 is increased in size, but such a configuration can also obtain the effects of the present invention.

Figure 13A:
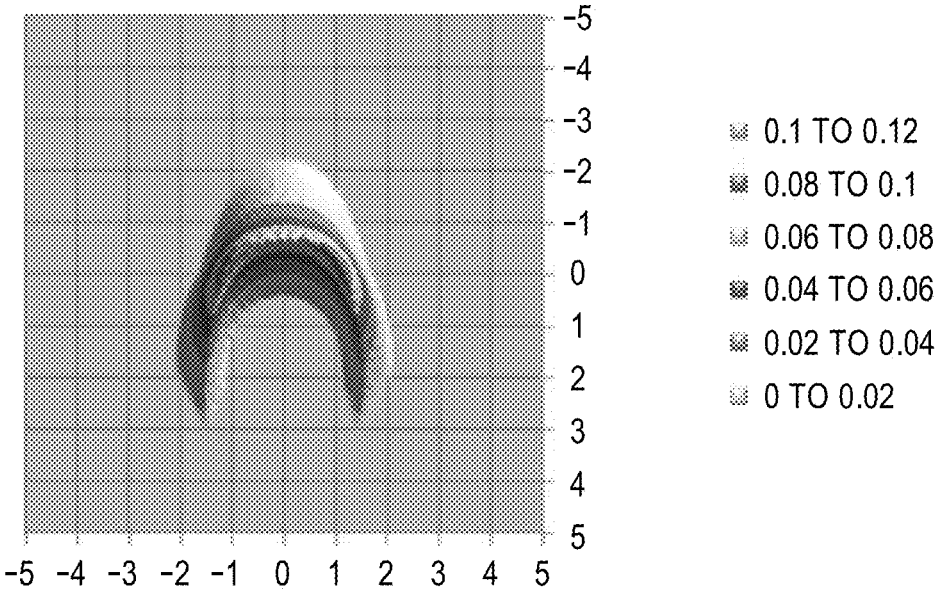
FIG. 13A is an illumination distribution on an illuminated surface obtained by the illumination optical system according to the third embodiment at the time of the nominal arrangement.
Figure 13B:
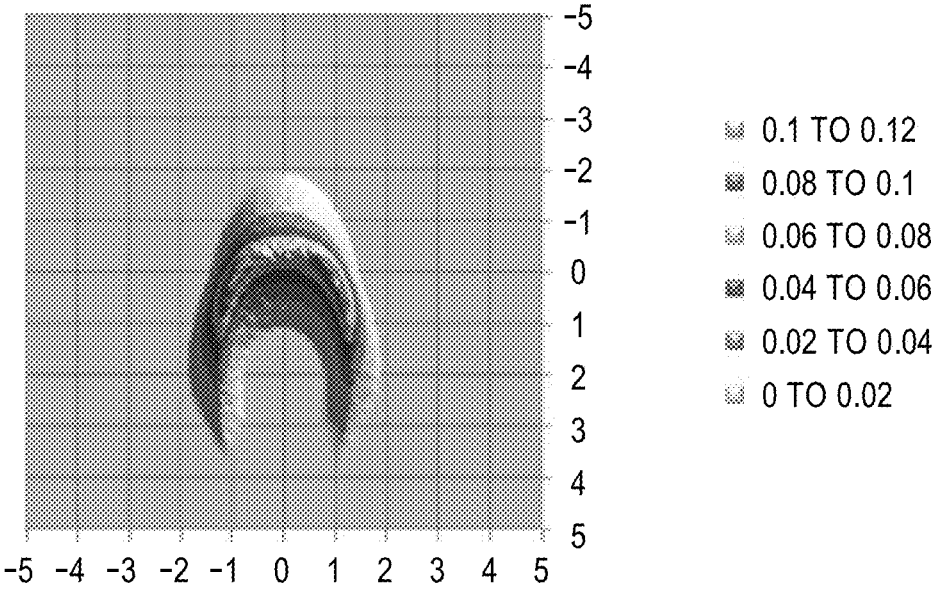
FIG. 13B is an illumination distribution on the illuminated surface obtained by the illumination optical system according to the third embodiment at the time of the non-nominal arrangement.

FIG. 13A and FIG. 13B are illumination distributions on the illuminated surface 120 obtained by the illumination optical system 80 according to the third embodiment at the time of the light source nominal arrangement and at the time of the light source non-nominal arrangement, respectively. The vertical axis represents the X direction, and the lateral axis represents the Y direction. In this case, the light source nominal arrangement means an arrangement in which the center of the light emitting surface of the LED 100 is arranged at coordinates (X, Y, Z)=(−1, 0, −14) shown in Table 4. In other words, the LED 100 is arranged so as to be separated by Δ=1 mm from the light-source-side focal point 112*b* in the normal direction to the light emitting surface of the LED 100. Further, the light source non-nominal arrangement means an arrangement in which the LED 100 approaches the ellipsoidal reflection surface 112 along the Z direction with respect to the position of the LED 100 at the time of the nominal arrangement. That is, the light source non-nominal arrangement means that the center of the light emitting surface of the LED 100 is arranged at coordinates (X, Y, Z)=(−1, 0, −14.1).

Further, the values shown in FIG. 13A and FIG. 13B are light amount densities for 1 $mm^2$ when the amount of light illuminating the illuminated surface 120 at the time of the light source nominal arrangement is normalized to 1.

In this case, a position at which, when the LED 100 is arranged at the nominal arrangement, the detection unit (not shown) can detect the light amount of the light flux illuminating the illuminated surface at the highest efficiency is referred to as the detection center position (see Table 4), and the area of 0.2 mm×0.2 mm about the detection center position is referred to as the detection area.

In other words, the detection center position refers to a position at which, when the LED 100 is arranged at the nominal arrangement, the sum of the light amount of the light flux illuminating the detection area (0.2 mm×0.2 mm) on the illuminated surface is the largest.

At this time, referring to FIG. 13A and FIG. 13B, the detected light amount at the time of the light source non-nominal arrangement is 78% of the detected light amount at the time of the light source nominal arrangement. Therefore, it is understood that, in the illumination optical system 80 according to this embodiment, even when the light source nominal arrangement is changed to the light source non-nominal arrangement, the light amount (detected light amount) of the light flux illuminating the detection area on the illuminated surface 120 is not sharply decreased.

Fourth Embodiment

Figure 14A:
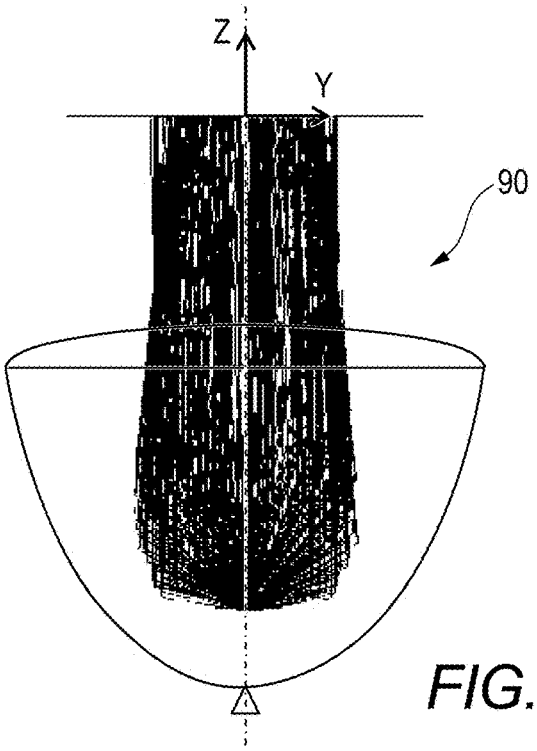
FIG. 14A is a YZ sectional view of an illumination optical system according to a fourth embodiment of the present invention.
Figure 14B:
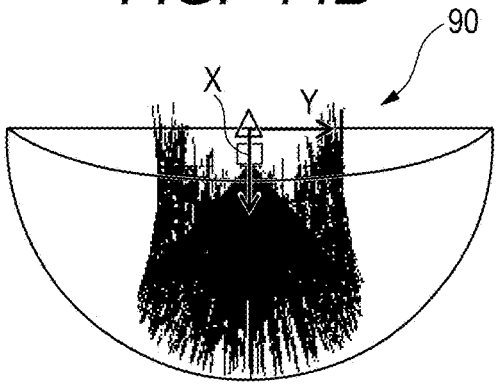
FIG. 14B is an XY sectional view of the illumination optical system according to the fourth embodiment.
Figure 14C:
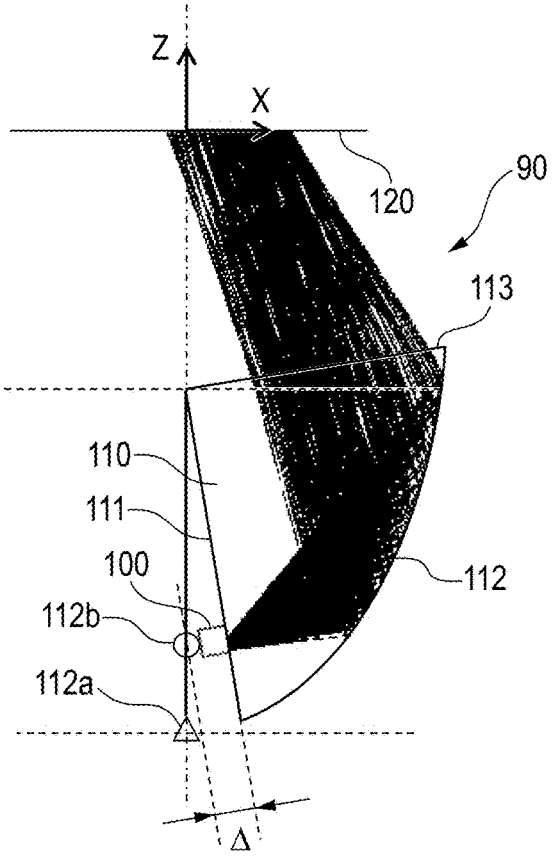
FIG. 14C is an XZ sectional view of the illumination optical system according to the fourth embodiment.

FIG. 14A, FIG. 14B, and FIG. 14C are a YZ sectional view, an XY sectional view, and an XZ sectional view, respectively, of an illumination optical system 90 according to a fourth embodiment of the present invention.

In Table 5 below, optical design values of the illumination optical system 90 according to the fourth embodiment are shown.

TABLE 5

Optical design values of illumination optical system 90 according to fourth embodiment

| | Symbol | Value |
|---|---|---|
| LED dominant wavelength | λ | 780 nm |
| Refractive index | n(λ) | 1.49361 |
| Ellipsoidal aspheric surface coefficient | R | 4.00328 |
| | K | −0.67186 |
| Light source main exit angle | θ | 99.46 |
| Separation amount between focal point and light source (mm) | Δ | 1 |
| Maximum value of separation amount between focal point and light source (mm) | Δmax | 4.627 |
| Ellipsoidal reflection surface magnification | β | 4.3 |
| Light source main incident angle | φ | 43.1 |
| Critical angle | φm | 42.0 |

| | Coordinate | | | Tilt (surface normal direction) | | |
|---|---|---|---|---|---|---|
| | X | Y | X | TiltX | TiltY | TiltZ |
| LED light emitting surface center position | 0.986 | 0 | −13.836 | — | — | — |
| Incident surface vertex | 0.986 | 0 | −13.836 | — | 80.54 | 0 |
| Ellipsoidal reflection surface vertex | 0 | 0 | −16.2 | 90 | 0 | — |

TABLE 5-continued

| Optical design values of illumination optical system 90 according to fourth embodiment | | | | | | |
|---|---|---|---|---|---|---|
| Ellipsoidal reflection surface light-source-side focal point | 0 | 0 | −14 | — | — | — |
| Exit surface vertex | 0 | 0 | −7 | 90 | −9.46 | — |
| Illuminated surface | 0 | 0 | 0 | 0 | 0 | — |
| Detection center position | 2.6 | 0 | 0 | — | — | — |

The illumination optical system 90 according to the fourth embodiment includes like components as those of the illumination optical system 10 according to the first embodiment, and hence the components are denoted by like reference symbols to omit the description thereof. The illumination optical system 90 according to the fourth embodiment differs from the illumination optical system 10 according to the first embodiment in that the incident surface 111 is inclined with an angle of 9.46° with respect to the YZ plane, and further the exit surface 113 is inclined with an angle of 90° with respect to the incident surface 111.

With such a configuration, the degree of freedom of the relative arrangement relationship between the light source 100 and the illuminated surface 120 can be obtained. Further, a general LED has the largest light distribution intensity in the normal direction to the light emitting surface, and hence the illumination efficiency can be developed by causing the light flux in the normal direction to be easily reflected by the ellipsoidal reflection surface 112.

Figure 15A:
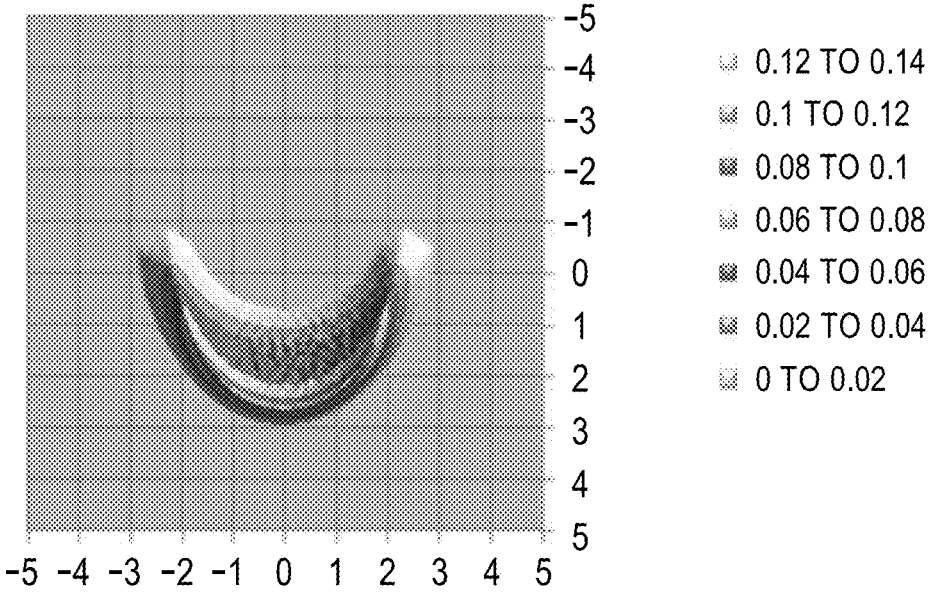
FIG. 15A is an illumination distribution on an illuminated surface obtained by the illumination optical system according to the fourth embodiment at the time of the nominal arrangement.
Figure 15B:
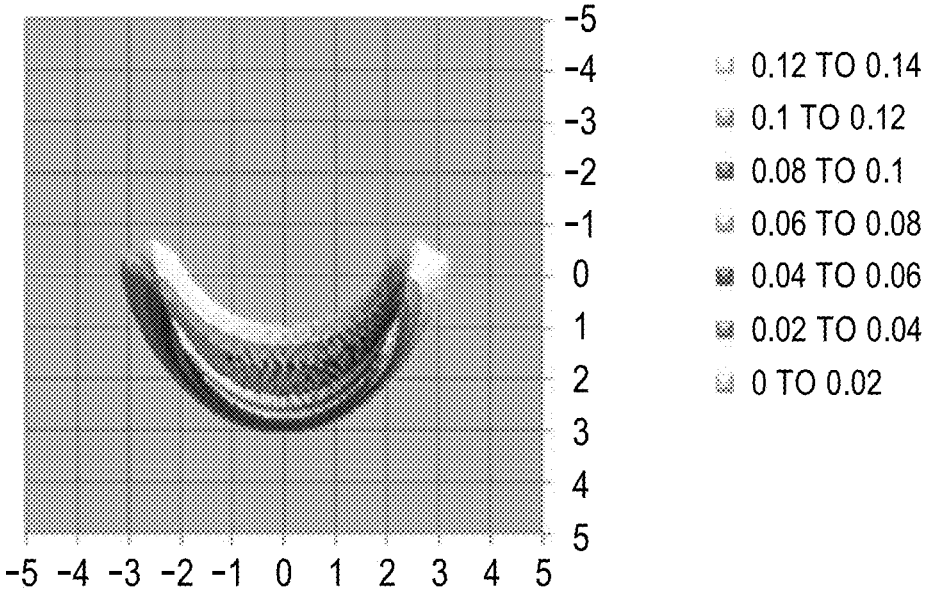
FIG. 15B is an illumination distribution on the illuminated surface obtained by the illumination optical system according to the fourth embodiment at the time of the non-nominal arrangement.

FIG. 15A and FIG. 15B are illumination distributions on the illuminated surface 120 obtained by the illumination optical system 90 according to the fourth embodiment at the time of the light source nominal arrangement and at the time of the light source non-nominal arrangement, respectively. The vertical axis represents the X direction, and the lateral axis represents the Y direction. In this case, the light source nominal arrangement means an arrangement in which the center of the light emitting surface of the LED 100 is arranged at coordinates (X, Y, Z)=(0.986, 0, −13.836) shown in Table 5. That is, the LED 100 is arranged so as to be separated by Δ=1 mm from the light-source-side focal point 112*b* in the normal direction to the light emitting surface of the LED 100. Further, the light source non-nominal arrangement means such an arrangement that the LED 100 is arranged so as to be shifted from the nominal position within the XZ plane along the incident surface 111 so as to approach the ellipsoidal reflection surface 112 by 0.1 mm. That is, the light source non-nominal arrangement means that the center of the light emitting surface of the LED 100 is arranged at coordinates (X, Y, Z)=(1.002, 0, −13.934).

Further, the values shown in FIG. 15A and FIG. 15B are light amount densities for 1 $mm^2$ when the amount of light illuminating the illuminated surface 120 at the time of the light source nominal arrangement is normalized to 1.

In this case, a position at which, when the LED 100 is arranged at the nominal arrangement, the detection unit (not shown) can detect the light amount of the light flux illuminating the illuminated surface at the highest efficiency is referred to as the detection center position (see Table 5), and the area of 0.2 mm×0.2 mm about the detection center position is referred to as the detection area.

In other words, the detection center position refers to a position at which, when the LED 100 is arranged at the nominal arrangement, the sum of the light amount of the light flux illuminating the detection area (0.2 mm×0.2 mm) on the illuminated surface is the largest.

At this time, referring to FIG. 15A and FIG. 15B, the detected light amount at the time of the light source non-nominal arrangement is 92% of the detected light amount at the time of the light source nominal arrangement. Therefore, it is understood that, in the illumination optical system 90 according to this embodiment, even when the light source nominal arrangement is changed to the light source non-nominal arrangement, the light amount (detected light amount) of the light flux illuminating the detection area on the illuminated surface 120 is not sharply decreased.

As described above, in the illumination optical system 90 according to this embodiment, the incident surface 111 and the exit surface 113 of the light guiding member 110 are respectively arranged so as to be non-parallel to the major axis and the minor axis of the ellipsoidal reflection surface 112 (major axis and minor axis of the spheroid forming the ellipsoidal reflection surface 112). With this, the degree of freedom of the relative arrangement relationship between the LED 100 and the illuminated surface 120 can be obtained.

Further, the angle formed between the incident surface 111 and the exit surface 113 is 90°, and hence the configuration has an advantage in holding the light guiding member 110.

Further, the non-parallel angle of the incident surface 111 with respect to the major axis of the ellipsoidal reflection surface 112 is adjusted so that a light flux in the normal direction to the light emitting surface, which has a large intensity in light distribution of the LED 100, can be easily totally reflected by the ellipsoidal reflection surface 112. Thus, the efficiency of the light flux illuminating the illuminated surface can be increased.

Further, the angle of the exit surface 113 can be changed. Thus, a wide ellipsoidal reflection surface 112 can be formed, and the illumination efficiency can be increased.

Fifth Embodiment

Figure 16A:
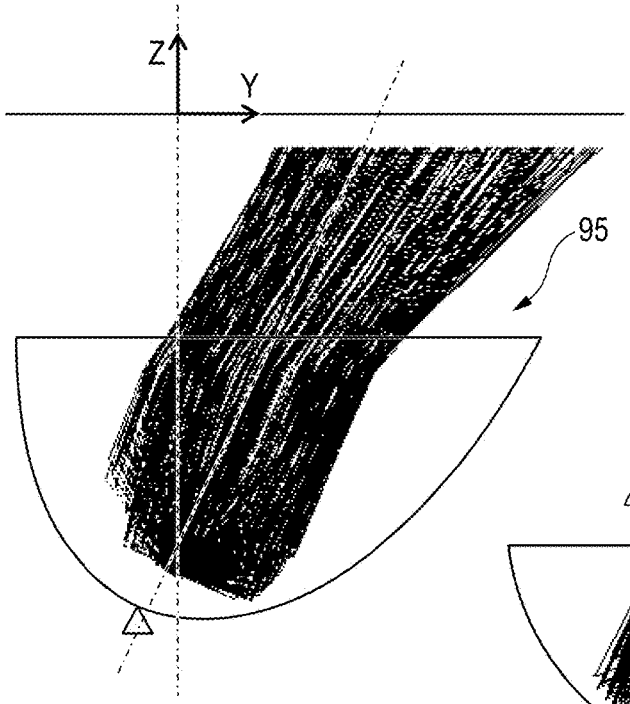
FIG. 16A is a YZ sectional view of an illumination optical system according to a fifth embodiment of the present invention.
Figure 16B:
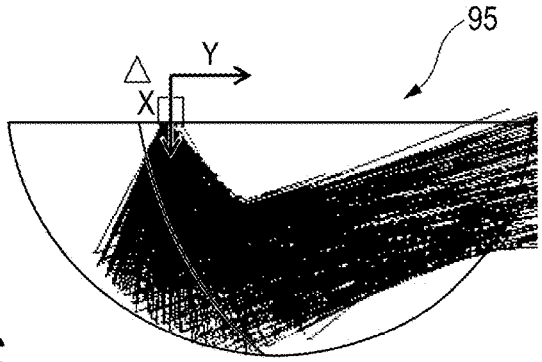
FIG. 16B is an XY sectional view of the illumination optical system according to the fifth embodiment.
Figure 16C:
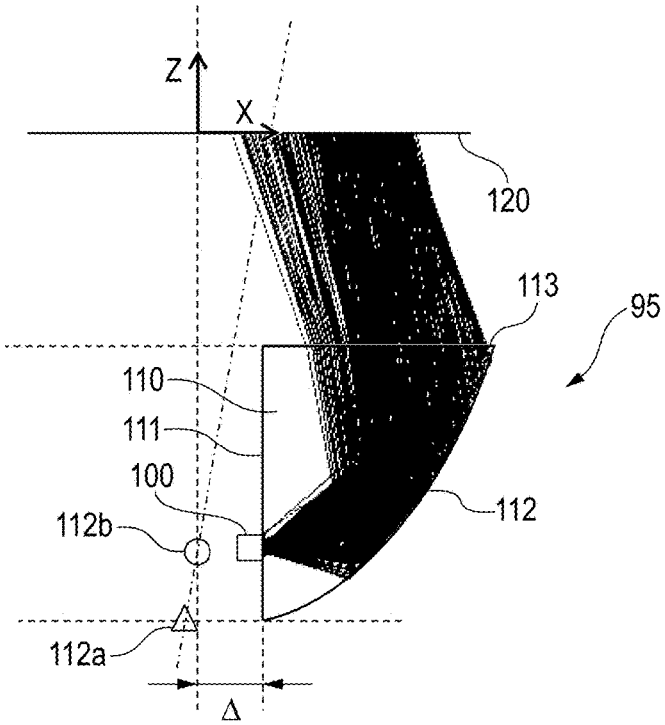
FIG. 16C is an XZ sectional view of the illumination optical system according to the fifth embodiment.

FIG. 16A, FIG. 16B, and FIG. 16C are a YZ sectional view, an XY sectional view, and an XZ sectional view, respectively, of an illumination optical system 95 according to a fifth embodiment of the present invention.

In Table 6 below, optical design values of the illumination optical system 95 according to the fifth embodiment are shown.

TABLE 6

| Optical design values of illumination optical system 95 according to fifth embodiment | | |
|---|---|---|
| | Symbol | Value |
| LED dominant wavelength | λ | 780 nm |
| Refractive index | n(λ) | 1.49361 |
| Ellipsoidal aspheric surface coefficient | R | 4.00328 |
| | K | −0.67186 |
| Light source main exit angle | θ | 99.46 |
| Separation amount between focal point and light source (mm) | Δ | 1.7 |
| Maximum value of separation amount between focal point and light source (mm) | Δmax | 4.627 |
| Ellipsoidal reflection surface magnification | β | 4.3 |

TABLE 6-continued

| Optical design values of illumination optical system 95 according to fifth embodiment | | |
|---|---|---|
| Light source main incident angle | φ | 43.1 |
| Critical angle | φm | 42.0 |

| | Coordinate | | | Tilt (surface normal direction) | | |
|---|---|---|---|---|---|---|
| | X | Y | Z | Tilt X | Tilt Y | Tilt Z |
| LED light emitting surface center position | 1.7 | 0 | −11.025 | — | — | — |
| Incident surface vertex | 1.7 | 0 | −11.025 | — | 90 | 0 |
| Ellipsoidal reflection surface vertex | −0.334 | −0.838 | −13.032 | 67.62 | 9.46 | — |
| Ellipsoidal reflection surface light-source-side focal point | 0 | 0 | −11.025 | — | — | — |
| Exit surface vertex | 0.881 | 2.208 | −5.735 | 90 | 0 | — |
| Illuminated surface | 0 | 0 | 0 | 0 | 0 | — |
| Detection center position | 5.464 | 9.067 | 0 | — | — | — |

The illumination optical system 95 according to the fifth embodiment includes like components as those of the illumination optical system 10 according to the first embodiment, and hence the components are denoted by like reference symbols to omit the description thereof. The illumination optical system 95 according to the fifth embodiment differs from the illumination optical system 10 according to the first embodiment in that the light guiding member 110 is designed and arranged as follows. The ellipsoidal reflection surface 112 is arranged such that the vertex of the ellipsoidal reflection surface is offset from the Z-axis, and the vertex of the exit surface is also offset from the Z-axis. With this, the light flux emitted from the light guiding member 110 illuminates the illuminated surface 120 about a position of $Y \neq 0$.

With such a configuration, the angle of the illumination light on the illuminated surface 120 can be adjusted.

Figure 17A:
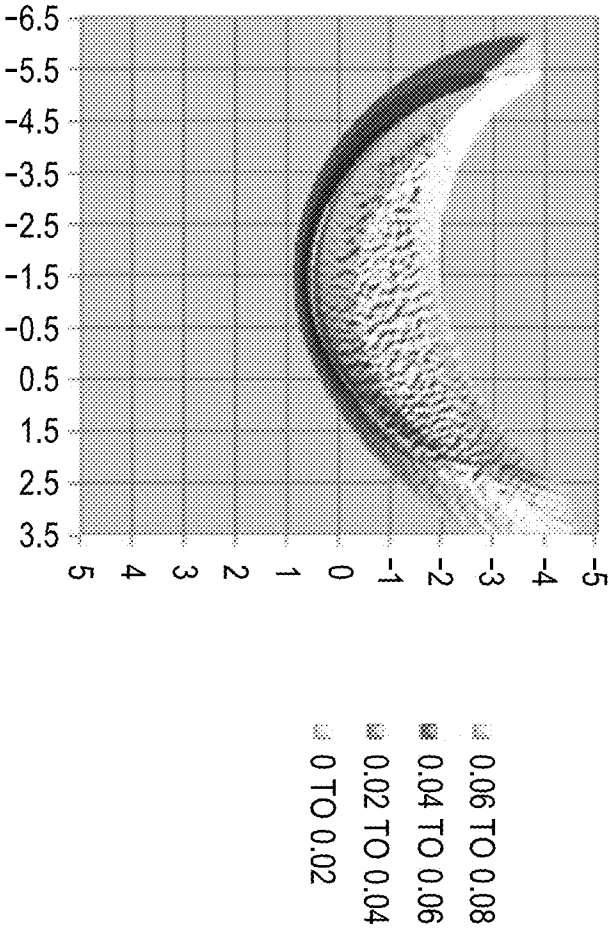
FIG. 17A is an illumination distribution on an illuminated surface obtained by the illumination optical system according to the fifth embodiment at the time of the nominal arrangement.
Figure 17B:
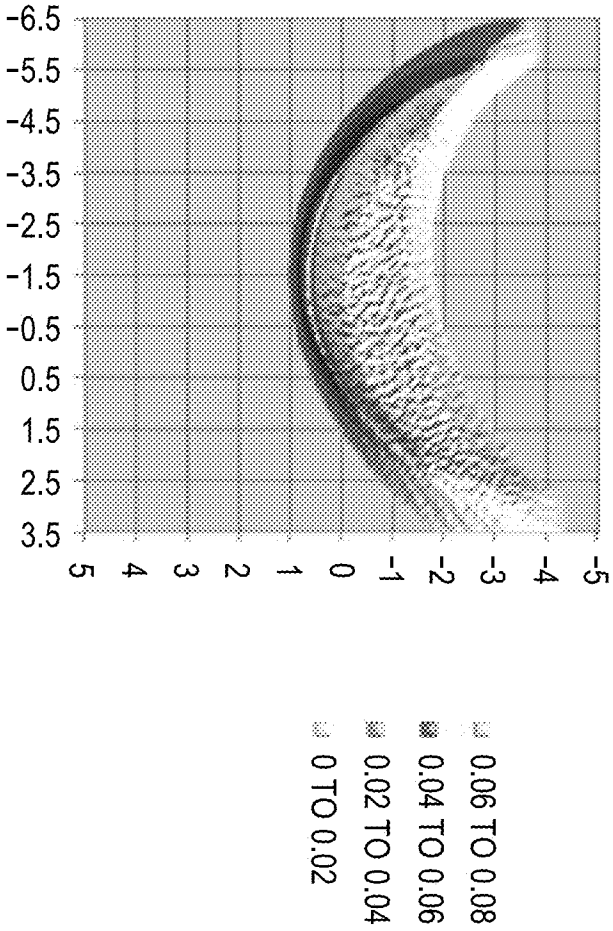
FIG. 17B is an illumination distribution on the illuminated surface obtained by the illumination optical system according to the fifth embodiment at the time of the non-nominal arrangement.

FIG. 17A and FIG. 17B are illumination distributions on the illuminated surface 120 obtained by the illumination optical system 95 according to the fifth embodiment at the time of the light source nominal arrangement and at the time of the light source non-nominal arrangement, respectively. The vertical axis represents the X direction, and the lateral axis represents the Y direction. In this case, the light source nominal arrangement means an arrangement in which the center of the light emitting surface of the LED 100 is arranged at coordinates (X, Y, Z)=(1.7, 0, −11.025) shown in Table 6. That is, the LED 100 is arranged so as to be separated by Δ=1 mm from the light-source-side focal point 112*b* in the normal direction to the light emitting surface of the LED 100. Further, the light source non-nominal arrangement means such an arrangement that the LED 100 is arranged so as to be shifted from the nominal position along the incident surface 111 so as to approach the ellipsoidal reflection surface 112 by 0.1 mm.

Further, the values shown in FIG. 17A and FIG. 17B are light amount densities for 1 $mm^2$ when the amount of light illuminating the illuminated surface 120 at the time of the light source nominal arrangement is normalized to 1.

In this case, a position at which, when the LED 100 is arranged at the nominal arrangement, the detection unit (not shown) can detect the light amount of the light flux illuminating the illuminated surface at the highest efficiency is referred to as the detection center position (see Table 6), and the area of 0.2 mm×0.2 mm about the detection center position is referred to as the detection area.

In other words, the detection center position refers to a position at which, when the LED 100 is arranged at the nominal arrangement, the sum of the light amount of the light flux illuminating the detection area (0.2 mm×0.2 mm) on the illuminated surface is the largest.

At this time, referring to FIG. 17A and FIG. 17B, the detected light amount at the time of the light source non-nominal arrangement is 98% of the detected light amount at the time of the light source nominal arrangement. Therefore, it is understood that, in the illumination optical system 95 according to this embodiment, even when the light source nominal arrangement is changed to the light source non-nominal arrangement, the light amount (detected light amount) of the light flux illuminating the detection area on the illuminated surface 120 is not sharply decreased.

In the illumination optical system according to this embodiment, the ellipsoidal reflection surface 112 is a curved surface, but the ellipsoidal reflection surface is not necessarily a curved surface. As long as the ellipsoidal reflection surface has a shape that can be approximately regarded as an ellipse (substantially ellipsoidal reflection surface shape), for example, even when the ellipsoidal reflection surface is formed of multiple planes, the effects of the present invention can be obtained.

Further, when the illuminated surface 120 is arranged outside of the light guiding member 110 as in the illumination optical system according to this embodiment, typically, the illumination position on the illuminated surface 120 of the light flux emitted from the light guiding member 110 is shifted from the focal point position $P_2$ of the ellipsoidal reflection surface 112 on the illuminated surface 120 side.

Therefore, the illuminated surface 120 is not required to include the focal point position $P_2$ of the ellipsoidal reflection surface 112 on the illuminated surface 120 side, and as long as the illuminated surface 120 is arranged at a position at which the light flux emitted from the light guiding member 110 is roughly collected, the effects of the present invention can be obtained.

Further, in the illumination optical system according to this embodiment, the ellipsoidal reflection surface 112 is not subjected to reflection film (coating) or the like, but the present invention is not necessarily limited to this configuration. Even when vapor-deposition of the reflection film is performed or surface processing is performed for adjusting the reflectance, the effects of the present invention can be obtained.

Further, in the illumination optical system according to this embodiment, the incident surface 111 of the light guiding member 110 to which the LED 100 is arranged close is a plane.

With this, the following effects can be obtained. The divergence of the light flux emitted from the LED light source 100 can be suppressed, the light flux emitted from the LED light source 100 can be used with high efficiency, and the LED light source 100 can be easily mounted to the light guiding member 110.

Further, in the illumination optical system according to this embodiment, the light guiding member 110 has only one reflection surface.

In this manner, as compared to the illumination optical system having a plurality of reflection surfaces, such an effect that the light guiding member can be easily downsized and molded can be obtained.

Further, in the illumination optical system according to this embodiment, the exit surface 113 of the light guiding member 110 is a plane.

With this, as compared to the illumination optical system in which the exit surface is a curved surface, such an effect that the light guiding member can be easily downsized and processed can be obtained.

Further, in the illumination optical system according to this embodiment, a light emitting diode (LED) is employed as the light source, but the present invention is not limited thereto. As the light source, the LED or an organic EL element, e.g., an organic light emitting diode (OLED) can be employed.

The LED and the OLED are suitable for the illumination optical system to be used in a sensor or the like because the light emitting portion can be formed small.

Such an illumination optical system tends to have a problem of a positional tolerance of a light emitting chip, and hence the effects of the present invention can be more enjoyed.

Further, the illumination optical system according to this embodiment can be configured such that the incident surface 111 of the light guiding member 110 is parallel to the major axis of the ellipsoidal reflection surface 112, and the exit surface 113 is not perpendicular to the major axis of the ellipsoidal reflection surface 112.

[Spectrophotometric Apparatus]

Figure 18:
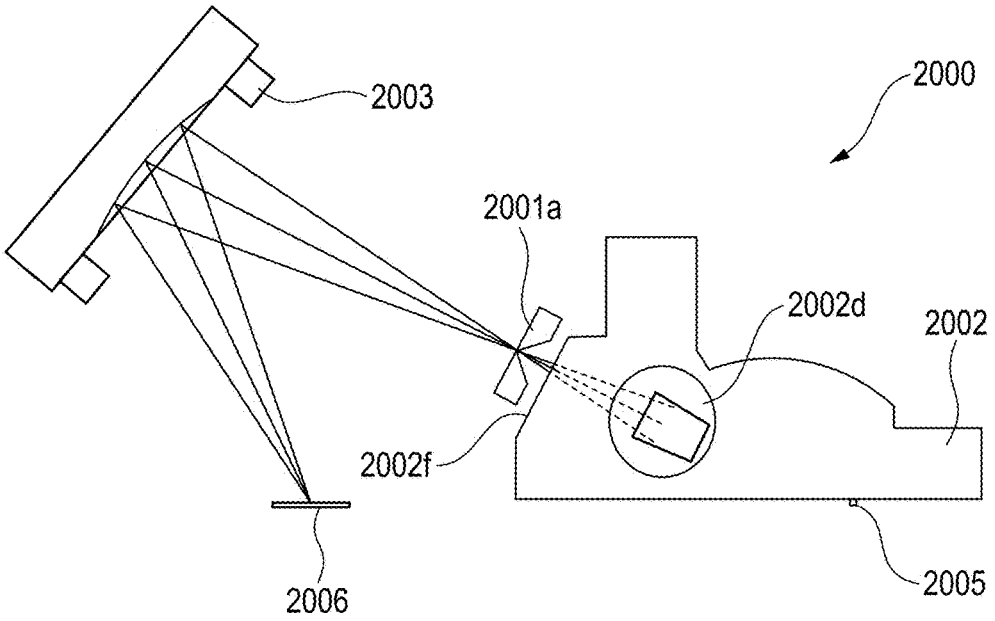
FIG. 18 is a main-part top view of a spectrophotometric apparatus which is to be used in an image forming apparatus and has the illumination optical system according to the embodiment mounted thereon.
Figure 19:
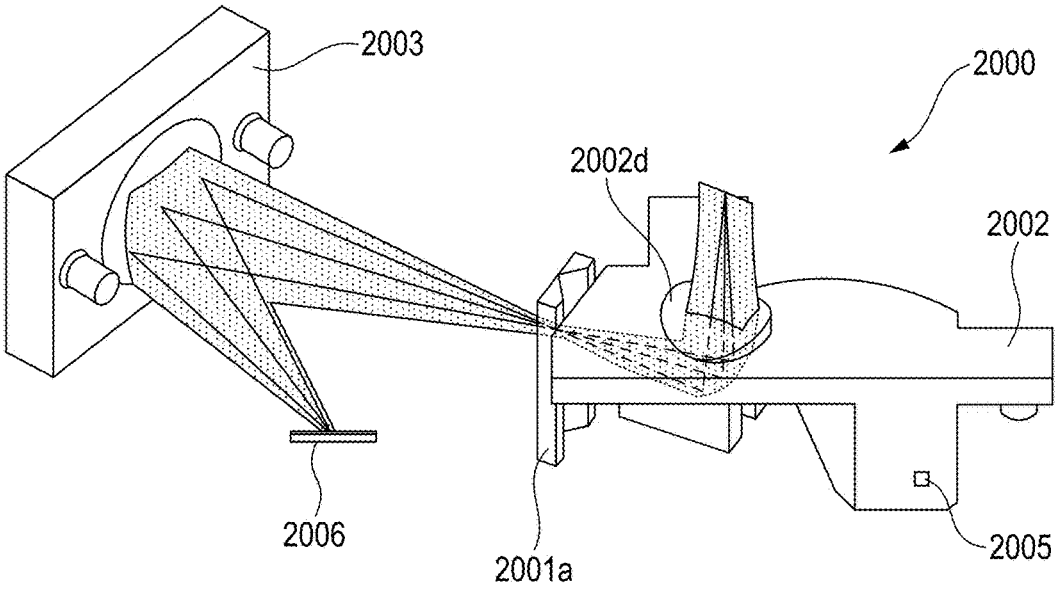
FIG. 19 is a main-part perspective view of the spectrophotometric apparatus which is to be used in the image forming apparatus and has the illumination optical system according to the embodiment mounted thereon.

FIG. 18 is a main-part top view of a spectrophotometric apparatus 2000 which is to be used in an image forming apparatus and has the illumination optical system according to this embodiment mounted thereon. FIG. 19 is a main-part perspective view of the spectrophotometric apparatus 2000 which is to be used in the image forming apparatus and has the illumination optical system according to this embodiment mounted thereon.

The spectrophotometric apparatus 2000 is configured to hold, on a casing (not shown), a light guiding member 2002 and a diffraction element 2003.

A light source 2005 and a light receiving element 2006 are mounted on an electric board (not shown). The electric board is fixed to the casing by screws. A slit 2001*a* is integrally formed in the resin casing. On an opening side of the casing, a cover (not shown) including a PET cover sheet (not shown) is mounted. An aperture window is formed in a part of the cover for the necessity of securing optical paths of illumination light traveling from the light guiding member 2002 to a color patch (not shown) and reflected light guided from the color patch to the light guiding member 2002. The cover sheet is mounted to the aperture window such that dust and paper powder do not enter the casing through the aperture window.

The light source 2005 is a white LED of what is generally called a top-view type and has a light emitting portion of 0.2 mm×0.2 mm. The light source 2005 is configured to emit, from its light emitting surface, a radial light flux having an optical axis in a surface normal direction. The white LED serving as the light source 2005 has such a light distribution intensity characteristic that the light amount is the maximum in the surface normal direction to the light emitting surface, and the light amount is gradually decreased as the inclination from the surface normal is increased.

The light guiding member 2002 is an optical element made of an acrylic resin. Further, a light guiding member part for the illumination optical system, which includes the incident surface, the ellipsoidal reflection surface, and the exit surface (not shown), is formed integrally with a light guiding member part for a spectral optical system, which includes an anamorphic surface 2002*d*, a turn-back reflection surface (not shown), and an exit surface 2002*f*.

The diffraction element 2003 includes a concave-reflection diffraction grating, and is formed by vapor-depositing reflection film (coating) of aluminum or the like and enhanced reflection film of $SiO_2$ or the like on a resin optical element formed by injection molding.

The light receiving element 2006 is formed by arranging a plurality of photoelectric conversion elements such as Si photodiodes into an array in a spectral direction.

Next, a colorimetric method using the spectrophotometric apparatus 2000 is described.

The spectrophotometric apparatus 2000 includes the illumination optical system and the spectral optical system. The illumination optical system is configured to illuminate an object to be detected that is present on the illuminated surface, and the spectral optical system is configured to disperse the scattered light from the object to be detected, to thereby measure the color of the object to be detected.

The light beam emitted from the light source 2005 passes through the incident surface of the light guiding member 2002 abutting against the light source 2005, and is upwardly reflected by the ellipsoidal reflection surface to pass through the exit surface, to thereby be illuminated to an object to be detected, e.g., a color patch, which is present on the illuminated surface.

In the illumination optical system in which the light source is arranged close to the light guiding member, considering the divergence angle of the light flux immediately after entering the light guiding member and the total reflection condition, a necessary range of the ellipsoidal reflection surface is made clear. In this manner, the light guiding member can be decreased in size while securing sufficient illumination efficiency.

Part of the scattered light from the object to be detected that is present on the illuminated surface enters the anamorphic surface 2002*d* having a light collecting action in a direction parallel to the spectral direction of the light guiding member 2002. Then, after the entrance, the light is bent by the turn-back reflection surface to a direction parallel to a spectral plane, to thereby become a light flux formed into a substantial line image on the slit 2001*a*.

The light flux that has passed through the slit 2001*a* is dispersed by the diffraction element 2003, and is formed as a slit image for each wavelength on the light receiving element 2006. This is a simple Rowland spectrometer configuration that is effective for size reduction.

The dispersed slit images are collected on the respective photoelectric conversion elements of the light receiving element 2006 arranged into an array. A signal detected by each photoelectric conversion element is subjected to signal processing while correcting the spectral characteristic of the light source 2005 and the spectral sensitivity characteristic of the light receiving element 2006, to thereby calculate a color tone of the object to be detected.

The detection area by the spectral optical system is 0.2 mm×0.2 mm, and the center of the detection area is located at a most efficient position when the light source is located at the nominal position.

[Image Forming Apparatus]

Figure 20:
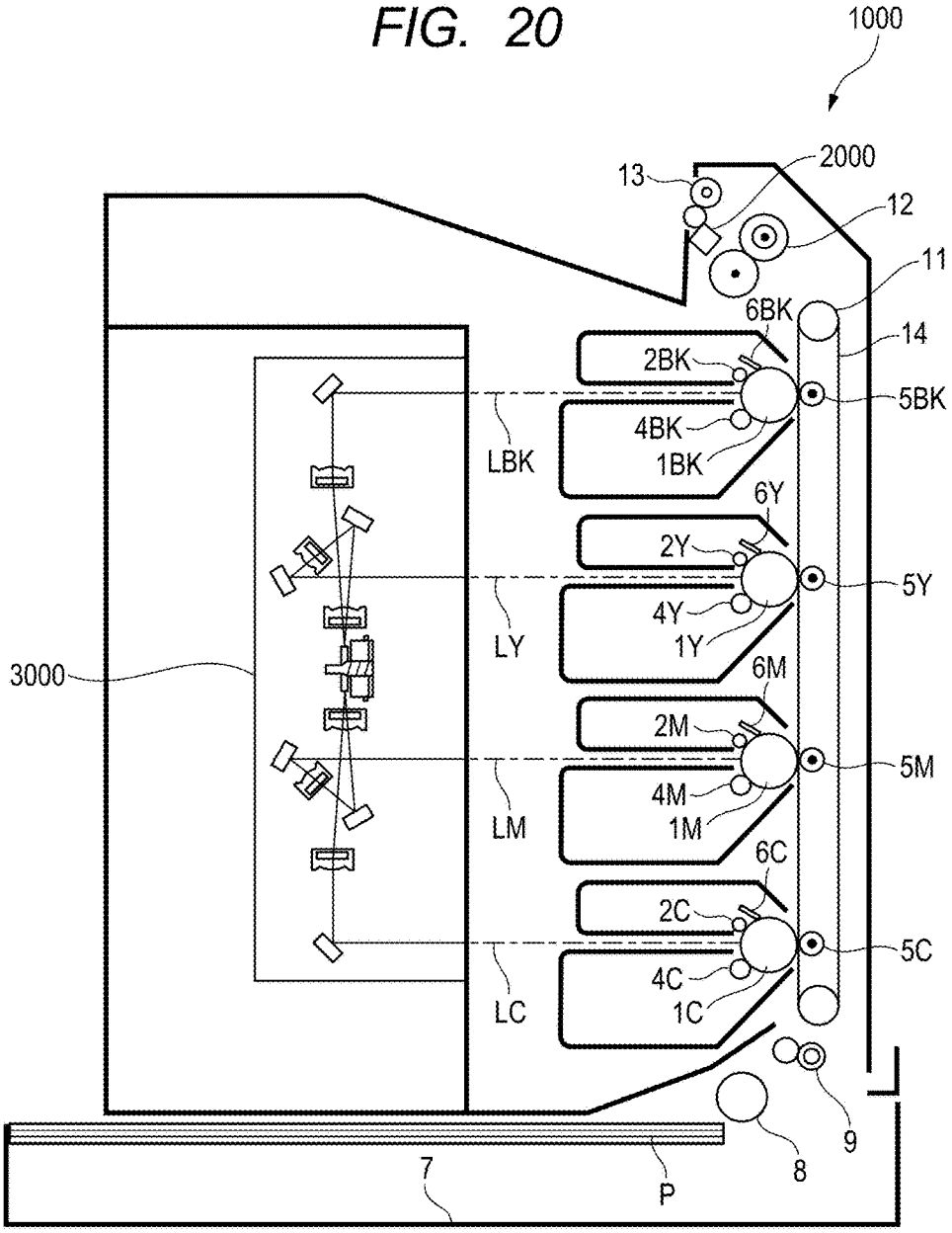
FIG. 20 is a side sectional view of a color image forming apparatus including the spectrophotometric apparatus having the illumination optical system according to the embodiment mounted thereon.

FIG. 20 is a side sectional view of a color image forming apparatus 1000 including the spectrophotometric apparatus 2000 having the illumination optical system according to the embodiments of the present invention mounted thereon.

The color image forming apparatus 1000 includes photosensitive drums (photosensitive bodies) 1C, 1M, 1Y, and 1BK serving as image bearing members arranged at equal intervals, primary charging units 2C, 2M, 2Y, and 2BK, and developing units 4C, 4M, 4Y, and 4BK.

Further, the color image forming apparatus 1000 includes a transfer belt 14, and transfer rollers 5C, 5M, 5Y, and 5BK.

Further, the color image forming apparatus 1000 includes cleaners 6C, 6M, 6Y, and 6BK.

Further, the color image forming apparatus 1000 includes an optical scanning apparatus 3000.

Light fluxes (laser beams) LC, LM, LY, and LBK that are respectively optically modulated based on image information are emitted from the optical scanning apparatus 3000. Each emitted light flux illuminates a photosensitive surface of corresponding one of the photosensitive drums 1C, 1M, 1Y, and 1BK that are respectively uniformly charged by the primary charging units 2C, 2M, 2Y, and 2BK, to thereby form electrostatic latent images.

The formed electrostatic latent images are formed into visible images (developed as toner images) of cyan, magenta, yellow, and black by the developing units 4C, 4M, 4Y, and 4BK, respectively. The visible images are sequentially electrostatically transferred onto a sheet material P (transfer material), which is conveyed on the transfer belt 14, by the transfer rollers 5C, 5M, 5Y, and 5BK (transfer units), to thereby form a color image on the sheet material P.

After that, residual toner remaining on the surfaces of the photosensitive drums 1C, 1M, 1Y, and 1BK is removed by the cleaners 6C, 6M, 6Y, and 6BK. Then, the photosensitive drums 1C, 1M, 1Y, and 1BK are uniformly charged again by the primary charging units 2C, 2M, 2Y, and 2BK in order to form the next color image.

The sheet materials P are stacked on a sheet feeding tray 7, and are sequentially fed one by one by a sheet feeding roller 8. Then, the sheet materials P are sent onto the transfer belt 14 in synchronization with the image writing start timing by registration rollers 9.

While the sheet materials P are conveyed onto the transfer belt 14 with high accuracy, the cyan image, the magenta image, the yellow image, and the black image formed on the surfaces of the photosensitive drums 1C, 1M, 1Y, and 1BK, respectively, are sequentially transferred onto the sheet material P to form a color image.

A drive roller 11 sends the transfer belt 14 with high accuracy, and is connected to a drive motor (not shown) having small rotation unevenness. The color image formed on the sheet material P is fixed by being pressurized and heated by a fixing unit 12. Then, the sheet material P is conveyed by sheet delivery rollers 13 or the like to be delivered outside of the apparatus.

The spectrophotometric apparatus 2000 is installed on a sheet conveyance path immediately after the fixing unit 12, and is arranged such that illumination light is illuminated on an image surface having fixed thereon a color patch formed on a sheet surface of the sheet material P.

For the sheet material P having the image of the color patch formed thereon through the fixing unit, the chromaticity of each color patch is detected by the spectrophotometric apparatus 2000 based on a color patch conveyed on the sheet. In this case, the color patch on the sheet surface after subjected to image fixing is measured in order to perform color matching considering the chromaticity change due to the sheet type or fixing.

Next, the detection result read by the spectrophotometric apparatus 2000 is transferred to a printer controller (not shown), and the printer controller determines whether the color reproducibility of the output color patch is appropriately made. When a color difference of the output single-color or mixed-color color patch falls within a predetermined range of the chromaticity instructed by the printer controller, the color calibration is ended. When the color difference is outside of the predetermined range, the printer controller can execute the color calibration based on the color difference information until the color difference falls within the predetermined range.

As described above, when the spectrophotometric apparatus 2000 is mounted on the color image forming apparatus, even if a chromaticity difference is caused in a color image formed on a sheet surface depending on the difference in image forming apparatus, the sheet type, the usage environment, the usage frequency, and the like, the chromaticity difference can be corrected to an absolute chromaticity under all conditions. Therefore, a stable chromaticity can be reliably reproduced, and thus an advanced color calibration can be executed.

According to the present invention, the illumination optical system capable of preventing an amount of light detected on the illuminated surface from being sharply decreased even when the light source is arranged at the non-nominal arrangement due to an arrangement error can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-221260, filed Nov. 11, 2015, which is hereby incorporated by reference herein in its entirety.

What is claimed is:

1. An illumination optical system, comprising:

a light source; and a light guiding member configured to guide a light flux emitted from the light source to an illuminated surface, the light guiding member having:

an incident surface into which the light flux from the light source enters;

an ellipsoidal reflection surface configured to reflect the light flux from the incident surface; and an exit surface from which the light flux reflected by the ellipsoidal reflection surface exits, wherein the light source is arranged so as to be separated from a first focal point of the ellipsoidal reflection surface at a position farther from the illuminated surface, in a direction perpendicular to a light emitting surface of the light source.

2. An illumination optical system according to claim 1, wherein the light emitting surface of the light source is arranged close to the incident surface of the light guiding member.

3. An illumination optical system according to claim 1, wherein, when a direction including two focal points of a spheroid defining the ellipsoidal reflection surface is defined as a z-axis, an intersection of the spheroid with the z-axis is defined as an origin, two directions that are orthogonal to the z-axis and perpendicular to each other are defined as an x-axis and a y-axis, and a surface shape of the spheroid is defined as:

$$Z = \frac{\frac{(x^2 + y^2)}{R}}{1 + \sqrt{1 - (1 + k)\frac{x^2 + y^2}{R^2}}}$$

and when $\Delta_{max}$ is set as follows:

$$\Delta_{max} = \frac{R}{1 + \sqrt{1 - (k + 1)}\cos\theta}$$

where R represents a curvature radius of the spheroid at the origin, k represents a conic constant, and θ represents an angle formed between the z-axis and a direction perpendicular to the light emitting surface of the light source, the light source is arranged so as to be separated by a distance Δ satisfying:

$$0.1\Delta_{max} \leq \Delta \leq 0.5\Delta_{max}$$

from the first focal point of the ellipsoidal reflection surface in the direction perpendicular to the light emitting surface of the light source.

4. An illumination optical system according to claim 1, wherein, when a direction including two focal points of a spheroid defining the ellipsoidal reflection surface is defined as a z-axis, an intersection of the spheroid with the z-axis is defined as an origin, two directions that are orthogonal to the z-axis and perpendicular to each other are defined as an x-axis and a y-axis, and a surface shape of the spheroid is defined as:

$$Z = \frac{\frac{(x^2 + y^2)}{R}}{1 + \sqrt{1 - (1 + k)\frac{x^2 + y^2}{R^2}}}$$

and when $\Delta_{max}$ is set as follows:

$$\Delta_{max} = \frac{R}{1 + \sqrt{1 - (k + 1)}\cos\theta}$$

where R represents a curvature radius of the spheroid at the origin, k represents a conic constant, and θ represents an angle formed between the z-axis and a direction perpendicular to the light emitting surface of the light source, the following expression is satisfied:

$$\frac{2R}{(k + 1)\Delta_{max}} - 1 > 1.$$

5. An illumination optical system according to claim 1, wherein, when a direction including two focal points of a spheroid defining the ellipsoidal reflection surface is defined as a z-axis, an intersection of the spheroid with the z-axis is defined as an origin, two directions that are orthogonal to the z-axis and perpendicular to each other are defined as an x-axis and a y-axis, and a surface shape of the spheroid is defined as:

$$Z = \frac{\frac{(x^2 + y^2)}{R}}{1 + \sqrt{1 - (1 + k)\frac{x^2 + y^2}{R^2}}}$$

and when $\Delta_{max}$ is set as follows:

$$\Delta_{max} = \frac{R}{1 + \sqrt{1 - (k + 1)}\cos\theta}$$

where R represents a curvature radius of the spheroid at the origin, k represents a conic constant, and θ represents an angle formed between the z-axis and a direction perpendicular to the light emitting surface of the light source, the following expression is satisfied:

$$\frac{1}{2}\arccos\left(\frac{2R^2}{\Delta_{max}[2R - (k + 1)\Delta_{max}]} - 1\right\} \geq \arcsin\left(\frac{1}{n}\right),$$

where n represents a refractive index of the light guiding member.

6. An illumination optical system according to claim 1, wherein the incident surface is a plane.

7. An illumination optical system according to claim 1, wherein the exit surface is a plane.

8. An illumination optical system according to claim 1, wherein the first focal point of the ellipsoidal reflection surface is located outside of the light guiding member.

9. An illumination optical system according to claim 1, wherein a second focal point of the ellipsoidal reflection surface is located on the illuminated surface.

10. An illumination optical system according to claim 1, wherein the incident surface is parallel to a major axis of the ellipsoidal reflection surface.

11. An illumination optical system according to claim 1, wherein the incident surface is non-parallel to a major axis of the ellipsoidal reflection surface.

12. An illumination optical system according to claim 1, wherein the exit surface is perpendicular to a major axis of the ellipsoidal reflection surface.

13. An illumination optical system according to claim 1, wherein the exit surface is prevented from being perpendicular to a major axis of the ellipsoidal reflection surface.

14. An illumination optical system according to claim 1, wherein the light guiding member comprises a solid light guiding member made of resin.

15. An illumination optical system according to claim 1, wherein the light source comprises one of an LED and an OLED.

16. An illumination optical system according to claim 1, wherein the light guiding member has only one reflection surface.

17. An illumination optical system according to claim 1, wherein the ellipsoidal reflection surface is subjected to reflection film.

18. A spectrophotometric apparatus, comprising:

an illumination optical system configured to illuminate an illuminated surface; and a spectral optical system configured to disperse scattered light from an object arranged on the illuminated surface to form an image of the object on a light receiving element, the illumination optical system comprising:

a light source; and a light guiding member configured to guide a light flux emitted from the light source to the illuminated surface, the light guiding member having:

an incident surface into which the light flux from the light source enters;

an ellipsoidal reflection surface configured to reflect the light flux from the incident surface; and an exit surface from which the light flux reflected by the ellipsoidal reflection surface exits, wherein the light source is arranged so as to be separated from a first focal point of the ellipsoidal reflection surface at a position farther from the illuminated surface, in a direction perpendicular to a light emitting surface of the light source.

19. An image forming apparatus, comprising:

a spectrophotometric apparatus;

developing units configured to develop, as toner images, electrostatic latent images formed on photosensitive surfaces of a plurality of photosensitive bodies, respectively;

transfer units configured to transfer the developed toner images onto a transfer material; and a fixing unit configured to fix the transferred toner images to the transfer material, the spectrophotometric apparatus comprising:

an illumination optical system configured to illuminate an illuminated surface; and a spectral optical system configured to disperse scattered light from an object arranged on the illuminated surface to form an image of the object on a light receiving element, the illumination optical system comprising:

a light source; and a light guiding member configured to guide a light flux emitted from the light source to the illuminated surface, the light guiding member having:

an incident surface into which the light flux from the light source enters;

an ellipsoidal reflection surface configured to reflect the light flux from the incident surface; and an exit surface from which the light flux reflected by the ellipsoidal reflection surface exits, wherein the light source is arranged so as to be separated from a first focal point of the ellipsoidal reflection surface at a position farther from the illuminated surface, in a direction perpendicular to a light emitting surface of the light source.

* * * * *